US005481281A

United States Patent [19]

Otsuka et al.

[11] Patent Number: 5,481,281

[45] Date of Patent: Jan. 2, 1996

[54] INK JET RECORDING APPARATUS AND METHOD CAPABLE OF PERFORMING HIGH-SPEED RECORDING

[75] Inventors: Naoji Otsuka, Kawasaki; Kentaro Yano; Kiichiro Takahashi, both of Yokohama; Atsushi Arai, Kawasaki; Hitoshi Nishikori, Yokohama; Osamu Iwasaki, Tokyo, all of Japan

[73] Assignee: Canon Kabushiki Kaisha, Tokyo, Japan

[21] Appl. No.: 133,213

[22] Filed: Oct. 7, 1993

Related U.S. Application Data

[62] Division of Ser. No. 872,924, Apr. 23, 1992.

[30] Foreign Application Priority Data

Apr. 26, 1991 [JP] Japan ..... 3-097249
Mar. 31, 1992 [JP] Japan ..... 4-077411

[51] Int. Cl.[6] ..... B41J 2/01
[52] U.S. Cl. ..... 347/12
[58] Field of Search ..... 347/9, 12, 13

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,580,148 | 4/1986 | Domoto et al. | 346/140 R |
| 4,723,129 | 2/1988 | Endo et al. | 346/1.1 |
| 4,740,796 | 4/1988 | Endo et al. | 346/1.1 |
| 5,138,333 | 8/1992 | Bartky et al. | 346/1.1 |
| 5,173,717 | 12/1992 | Kishida et al. | 347/13 |

FOREIGN PATENT DOCUMENTS

| | | |
|---|---|---|
| 0208484 | 1/1987 | European Pat. Off. . |
| 0354706 | 2/1990 | European Pat. Off. . |
| 59-123670 | 7/1984 | Japan . |
| 59-138461 | 8/1984 | Japan . |
| 1180353 | 7/1989 | Japan . |

*Primary Examiner*—N. Le
*Attorney, Agent, or Firm*—Fitzpatrick, Cella, Harper & Scinto

[57] ABSTRACT

An ink is ejected at the same timing from ejection orifices in a number corresponding to an ink quantity 7% or less of an ink quantity ejected from all the ejection enabled ejection orifices of a plurality of ejection orifices of a recording head, and the ink ejection period from all the ejection enabled ejection orifices is set to be 70% or more of the driving period. Since the quantity of an ink ejected per unit time is minimized, and the negative pressure level generated in a common ink chamber can be set to be closest to normal pressure, the amplitude of a refill oscillation is minimized to stabilize ejection, and the driving frequency can be further increased.

12 Claims, 25 Drawing Sheets

INK JET RECORDING APPARATUS AND METHOD CAPABLE OF PERFORMING HIGH-SPEED RECORDING

This application is a division of application Ser. No. 07/872,924 filed Apr. 23, 1992.

BACKGROUND OF THE INVENTION

1. Field of the Invention

The present invention relates to an ink jet recording apparatus for performing recording by ejecting an ink from a recording head to a recording medium.

2. Related Background Art

Recording apparatuses such as a printer, a copying machine, a facsimile apparatus, and the like record an image consisting of a dot pattern on a recording medium such as a paper sheet, a plastic thin plate, or the like on the basis of image information. The recording apparatuses can be classified into an ink jet type, a wire-dot type, a thermal type, a laser beam type, and the like according to their recording methods. Of these recording apparatuses, an ink jet type (ink jet recording apparatus) ejects a flying ink (recording liquid) droplet from an ejection orifice of a recording head, and attaches the ink droplet to a recording medium to record data.

In recent years, a large number of recording apparatuses have been used, and high-speed recording, high resolution, high image quality, and low noise are required of these recording apparatuses. As a recording apparatus which can satisfy such requirements, the ink jet recording apparatus is of note. In the ink jet recording apparatus, since recording is performed by ejecting an ink from a recording head, a printing operation can be performed in a non-contact manner, and a very stable recorded image can be obtained.

Of ink jet recording apparatuses, in an apparatus for ejecting an ink by using a bubble generated by heat energy, the size of a heat generating resistor (heater) arranged in each ejection orifice is remarkably smaller than that of a piezoelectric element used in a conventional apparatus, and a high-density multi-structure of ejection orifices can be realized. A multi head having an array of a large number of ejection orifices is normally time-divisionally driven within a driving period in consideration of the upper limit value of a maximum consumption power allowing simultaneous driving of heaters.

In an ink jet recording method, since an ink as a liquid is handled, various undesirable hydrodynamic phenomena occur when a recording head is used at a speed equal to or higher than or near a critical printing speed. Since an ink is a liquid, the physical states such as the viscosity, surface tension and the like regarding the ink always largely vary depending on the environmental temperature, and the non-use time of the ink. Even when a printing operation can be performed in a given state, it may be disabled due to the environmental temperature or an increase in negative pressure due to a decrease in ink remaining quantity.

Conventionally, when an apparatus is used near a critical ejection period, an ejection error may occur, or the ejection quantity may be extremely decreased. Such situation occurs since refill of an ink to a nozzle (liquid channel) cannot catch up with ejection, and the next ejection is started before the ink is refilled.

In order to cope with this situation, the driving period may be prolonged, i.e., a driving operation may be performed at a period longer than the critical ejection period. However, to prolong the driving period contradicts with the above-mentioned high-speed recording requirement, and cannot be an essential solution.

SUMMARY OF THE INVENTION

The present invention has been made to solve the above problems, and has as its object to provide an ink jet recording apparatus, which can perform stable ink ejection, and can also perform high-speed recording.

It is another object of the present invention to provide an ink jet recording apparatus, which can refill an ink from a common ink chamber to nozzles at high speed.

In order to achieve the above objects, an ink jet recording apparatus of the present invention comprises:

a recording head having a plurality of ejection orifices for ejecting an ink, and a common ink chamber for supplying the ink to the plurality of ejection orifices; and driving means for causing the plurality of ejection orifices of the recording head to eject the ink, and wherein the driving means causes the ejection orifices to eject the ink at the same timing, a number of the ejection orifices corresponding to an ink quantity not more than 7% of an ink quantity ejected from all the ejectable ones of the plurality of ejection orifices of the recording head, and sets an ink ejection period from all the ejectable orifices to be not less than 70% of a driving period.

Thus, the quantity of the ink ejected per unit time is minimized, so that the level of a negative pressure generated in a common ink chamber approaches normal pressure. Therefore, the amplitude of oscillation of refill is minimized to stabilize ejection, thus further improving the driving frequency.

Furthermore, it is also advantageous in terms of improvement of the refill speed to inhibit the ink from being continuously ejected from adjacent ejection orifices.

An ink jet recording apparatus of the present invention comprises:

a recording head having a plurality of ejection orifices for ejecting an ink, and a common ink chamber for supplying the ink to the plurality of ejection orifices through corresponding passages; and driving means for causing the plurality of ejection orifices of the recording head to eject the ink, and wherein the plurality of ejection orifices of the recording head are divided into a plurality of ejection orifice groups having at least one ejection orifice for ejecting the ink at substantially the same timings, and the driving means causes the next ejection orifice group to be subjected to ejection to eject the ink at a timing near a timing at which a meniscus of the ink in the previous ejection orifice group, which ejected the ink, reaches a maximum recess position in the corresponding passage.

With this arrangement, since a reactive pressure wave can be applied before a maximum meniscus recess quantity is reached, an inertial force of the ink in a recess direction can be reduced, and a length to be actually refilled is decreased to shorten the refill period.

Furthermore, it is also effective in terms of an increase in refill speed itself to apply ejection reactive pulses a large number of times during a period 70% or more the driving period.

DETAILED DESCRIPTION OF THE PREFERRED EMBODIMENTS

An ink jet recording apparatus according to the preferred embodiments of the present invention will be described in detail below with reference to the accompanying drawings.

FIGS. 1 to 6B are explanatory views for explaining an ink jet unit IJU, an ink jet head IJH, an ink tank IT, an ink jet cartridge IJC, an ink jet recording apparatus main body IJRA, and a carriage HC, in or to which the present invention is embodied or applied, and their relationship. An explanation of the arrangement of respective sections will be given with reference to these drawings.

(i) Brief Description of Apparatus Main Body

Figure 1:
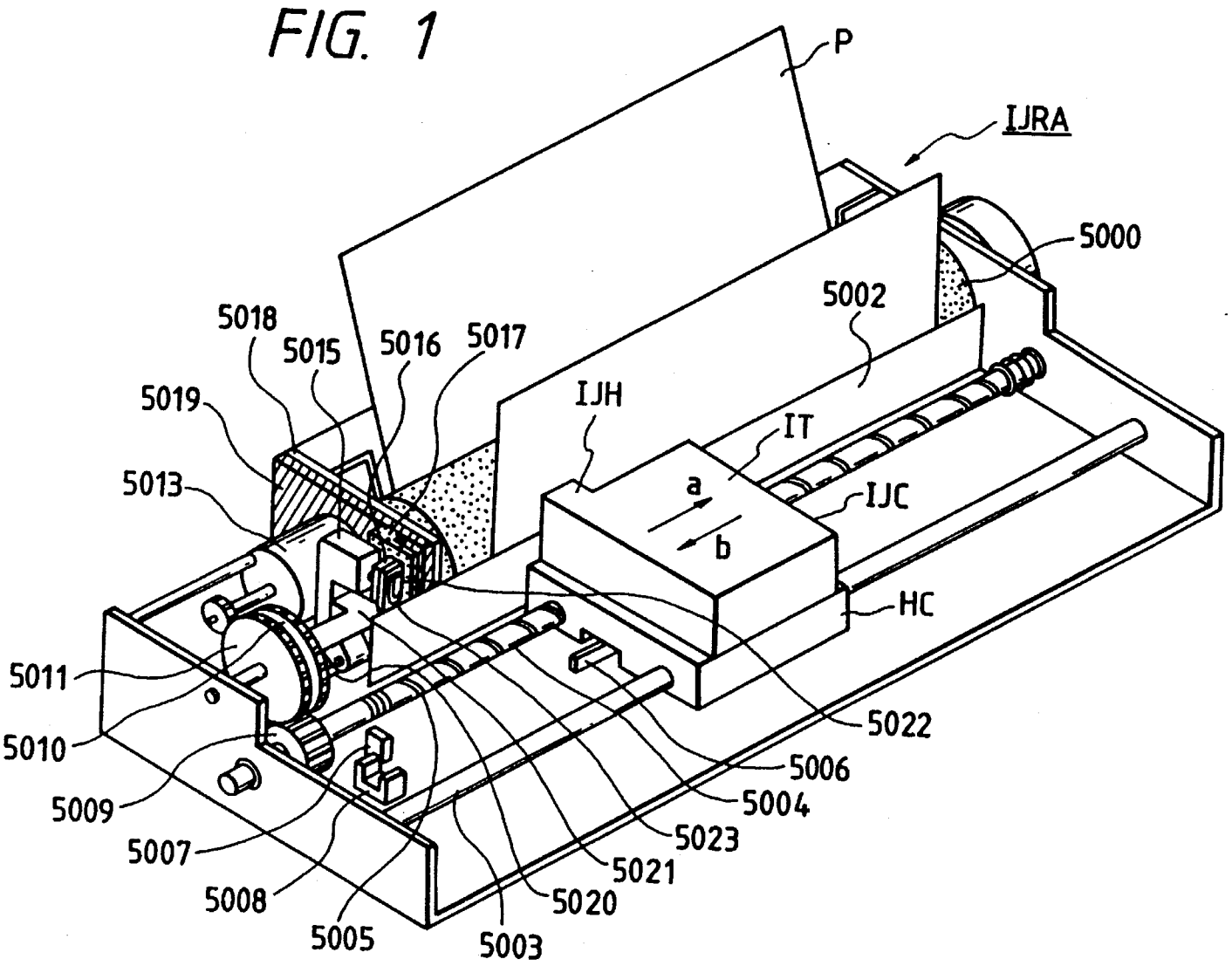
FIG. 1 is an explanatory view showing an ink jet recording apparatus main body which adopts the present invention.

FIG. 1 is a schematic view of an ink jet recording apparatus IJRA to which the present invention is applied. In FIG. 1, a carriage HC is engaged with a spiral groove 5004 of a lead screw 5005, which is rotated in cooperation with normal/reverse rotation of a driving motor 5013 through driving force transmission gears 5011 and 5009. The carriage HC has a pin (not shown), and is reciprocally moved in directions of arrows a and b in FIG. 1. The carriage HC carries an ink jet cartridge IJC. A sheet pressing plate 5002 presses a sheet against a platen 5000 across a carriage moving direction. Photocouplers 5007 and 5008 serve as home position detection means for confirming the presence of a lever 5006 of the carriage in a corresponding region, and switching the rotational direction of the motor 5013. A member 5016 supports a cap member 5022 for capping the front surface of a recording head. A suction means 5015 draws the interior of this cap member by vacuum suction, and performs suction recovery of the recording head through an intra-cap opening 5023. A cleaning blade 5017 is movable in the back-and-forth direction by a member 5019. The blade 5017 and the member 5019 are supported on a main body support plate 5018. The blade 5017 is not limited to the illustrated form, and a known cleaning blade may be applied to this embodiment, as a matter of course. A lever 5012 is used for starting suction of suction recovery, and is moved upon movement of a cam 5020 engaged with the carriage. A driving force from the driving motor is transmitted to the lever 5012 through a known transmission means such as clutch switching.

These capping, cleaning, and suction recovery means are arranged to execute desired processing at their corresponding positions upon operation of the lead screw 5005 when the carriage reaches a region at the side of the home position. However, any other means may be applied as long as desired operations are performed at known timings.

Figure 2:
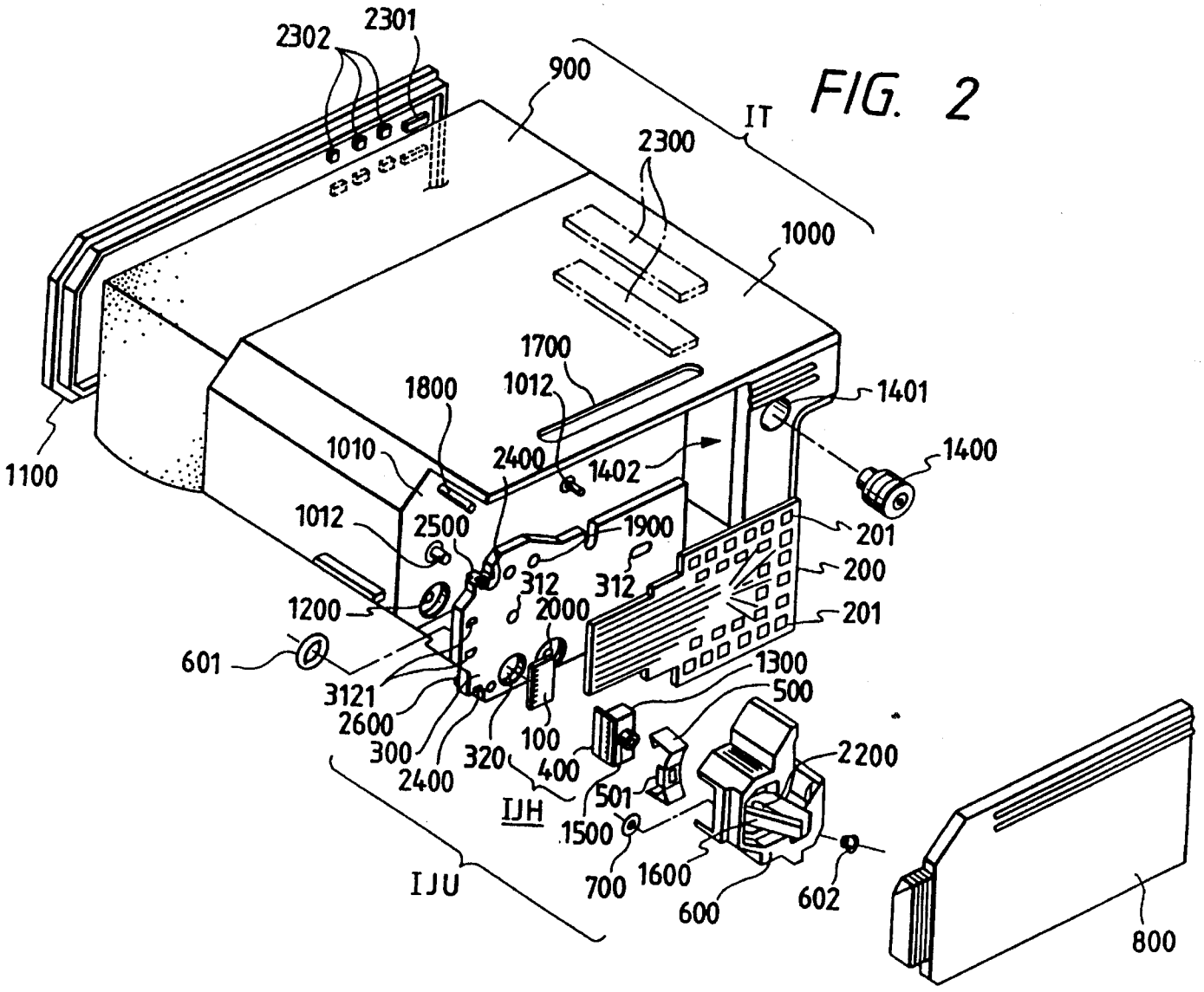
FIG. 2 is an exploded perspective view showing an ink jet cartridge.

As can be seen from the perspective view of FIG. 2, the ink jet cartridge IJC of this embodiment has an increased storage ratio of an ink, and has a shape that the distal end portion of an ink jet unit IJU projects slightly from the front surface of an ink tank IT. This ink jet cartridge IJC is fixed and supported by an aligning means and an electrical contact of the carriage HC (FIG. 1) mounted in the ink jet recording apparatus main body IJRA, as will be described later, and is detachable from the carriage HC.

(ii) Description of Arrangement of Ink Jet Unit IJU

The ink jet unit IJU is a unit of a type for performing recording using electrothermal converting elements for generating heat energy for causing film boiling in an ink according to an electrical signal.

In FIG. 2, a heater board 100 is constituted by forming a plurality of arrays of electrothermal converting elements (ejection heaters), and an electrical wiring layer (e.g., an Al layer) for supplying electrical power to these elements on an Si substrate by a film formation technique.

A wiring board 200 for the heater board 100 has a wiring layer (connected by, e.g., wire bonding) corresponding to the wiring layer of the heater board 100, and pads 201, located at end portions of the wiring layer, for receiving electrical signals from the main body apparatus.

A grooved top plate 1300 is provided with partition walls for partitioning a plurality of ink flow paths, a common ink chamber, and the like, and is constituted by integrally molding an ink reception (inlet) port 1500 for receiving an ink supplied from the ink tank, and guiding the ink toward the common ink chamber, and an orifice plate 400 having a plurality of ejection orifices. As an integrated molding material, polysulfone is preferable. However, other molding resin materials may be used.

A support member 300 formed of, e.g., a metal, supports the back surface of the wiring board 200, and serves as a bottom plate of the ink jet unit. A pressing spring 500 has an M shape to press the common ink chamber at the center of the M shape, and to press some nozzles at an apron portion 501 by a linear pressure. The leg portion of the pressing spring is engaged with the back surface side of the support member 300 through a hole 3121 of the support member 300 to engage the heater board 100 and the top plate 1300 with each other and to sandwich the support member 300 and the pressing spring 500 together. Thus, the heater board 100 and the top plate 1300 are fixed in position by the biasing force of the pressing spring 500 and its apron portion 501. The support member 300 has aligning holes 312, 1900, and 2000, which are engaged with two aligning projections 1012 of the ink tank IT, and projections 1800 and 1801 for aligning and thermal welding holding purposes, and also has aligning projections 2500 and 2600 for the carriage HC of the apparatus main body IJRA on its back surface side. In addition, the support member 300 has a hole 320 for allowing an ink supply tube 2200 (to be described later), used for ink supply from the ink tank, to extend therethrough. The wiring board 200 is adhered by the support member 300 by, e.g., an adhesive. Note that recesses 2400 of the support member 300 are formed near the aligning projections 2500 and 2600.

A lid member 800 forms the outer wall of the ink jet cartridge IJC, and also forms a space for storing the ink jet unit IJU. An ink supply member (or tank) 600 forms an ink guide tube 1600 contiguous with the above-mentioned ink supply tube 2200 as a cantilever, whose portion at the side of the supply tube 2200 is fixed, and a sealing pin 602 is inserted to assure a capillarity between the fixed side of the ink guide tube and the ink supply tube 2200. Note that a packing 601 provides a coupling seal between the ink tank IT and the supply tube 2200, and a filter 700 is arranged at the tank-side end portion of the supply tube.

(iii) Description of Arrangement of Ink Tank IT

The ink tank is constituted by a cartridge main body 1000, an ink absorbing member 900, and a lid member 1100 for sealing the ink absorbing member 900 after the ink absorbing member 900 is inserted from a side surface, opposite to the unit IJU mounting surface, of the cartridge main body 1000.

The ink absorbing member 900 is arranged in the cartridge main body 1000. A supply port 1200 is used for supplying an ink to the unit IJU constituted by the above-mentioned portions 100 to 600, and also serves as an injection port. That is, in a step before the unit is arranged on a portion 1010 of the cartridge main body 1000, an ink is injected from the supply port 1200 to impregnate the absorbing member 900 with the ink.

In this embodiment, portions allowing ink supply are an air communication port and this supply port. In order to attain satisfactory ink supply from the ink absorbing member, an intra-tank air region defined by ribs 2300 in the main body 1000, and partial ribs 2302 and 2301 of the lid member 1100 is formed to extend contiguously from the air communication port 1401 side to a corner portion farthest from the ink supply port 1200. For this reason, it is important to relatively satisfactorily and uniformly supply an ink to the absorbing member from the supply port 1200 side. This method is very effective in a practical application. The ribs 2300 include four ribs parallel to each other in the carriage moving direction on the rear surface of the ink tank main body 1000 to prevent the absorbing member from being in tight contact with the rear surface. The partial ribs 2302 and 2301 are arranged on the inner surface of the lid member 1100 to be located on the corresponding extending lines of the ribs 2300, but are split unlike the ribs 2300 to increase an air space compared to the ribs 2300. Note that the partial ribs 2302 and 2301 are distributed on a surface half or less the total area of the lid member 1100. Since these ribs are arranged, an ink in a corner portion region, farthest from the ink supply port 1200, of the ink absorbing member can be stably and reliably guided to the supply port 1200 side by a capillary force. A liquid repellent member 1400 is arranged inside the air communication port 1401 to prevent an ink from leaking from the air communication port 1401.

The ink storage space of the above-mentioned ink tank IT has a rectangular parallelopiped shape, and has its long sides on the side surface. For this reason, the above-mentioned rib arrangement is particularly effective. When the ink storage space has long sides in the carriage moving direction or has a cubic shape, ribs are arranged on the entire surface of the lid member 1100 to stabilize ink supply from the ink absorbing member 900.

The ink tank IT encloses the unit IJU excluding a lower opening since the unit IJU is covered with a lid 800 after it is attached. As the ink jet cartridge IJC, since the lower opening for mounting the cartridge on the carriage HC is close to the carriage HC, an essential four-way closed space is formed. Therefore, heat generated by the head IJH in the closed space is effective as a temperature keeping source in this space, but causes a slight temperature rise in a continuous use for a long period of time. For this reason, in this embodiment, a slit 1700 having a width smaller than this space is formed in the upper surface of the cartridge IJC to assist natural heat radiation of the support member, so that the temperature distribution of the entire unit IJU can be made uniform independently of an environmental condition while preventing a temperature rise.

After the ink jet cartridge IJC is assembled, the ink is supplied from the interior of the cartridge into the supply tank 600 through the supply port 1200, the hole 320 formed in the support member 300, and an inlet port formed in the middle rear surface side of the supply tank 600, and flows through the interior of the supply tank 600. Thereafter, the ink flows from an outlet port into the common ink chamber through an appropriate supply tube and the ink inlet port 1500 of the top plate 1300. In the above arrangement, packings formed of, e.g., silicone rubber or butyl rubber are arranged at connection portions for attaining ink communications so as to provide a seal, thereby assuring an ink supply path.

(iv) Description of Heater Board

Figure 3:
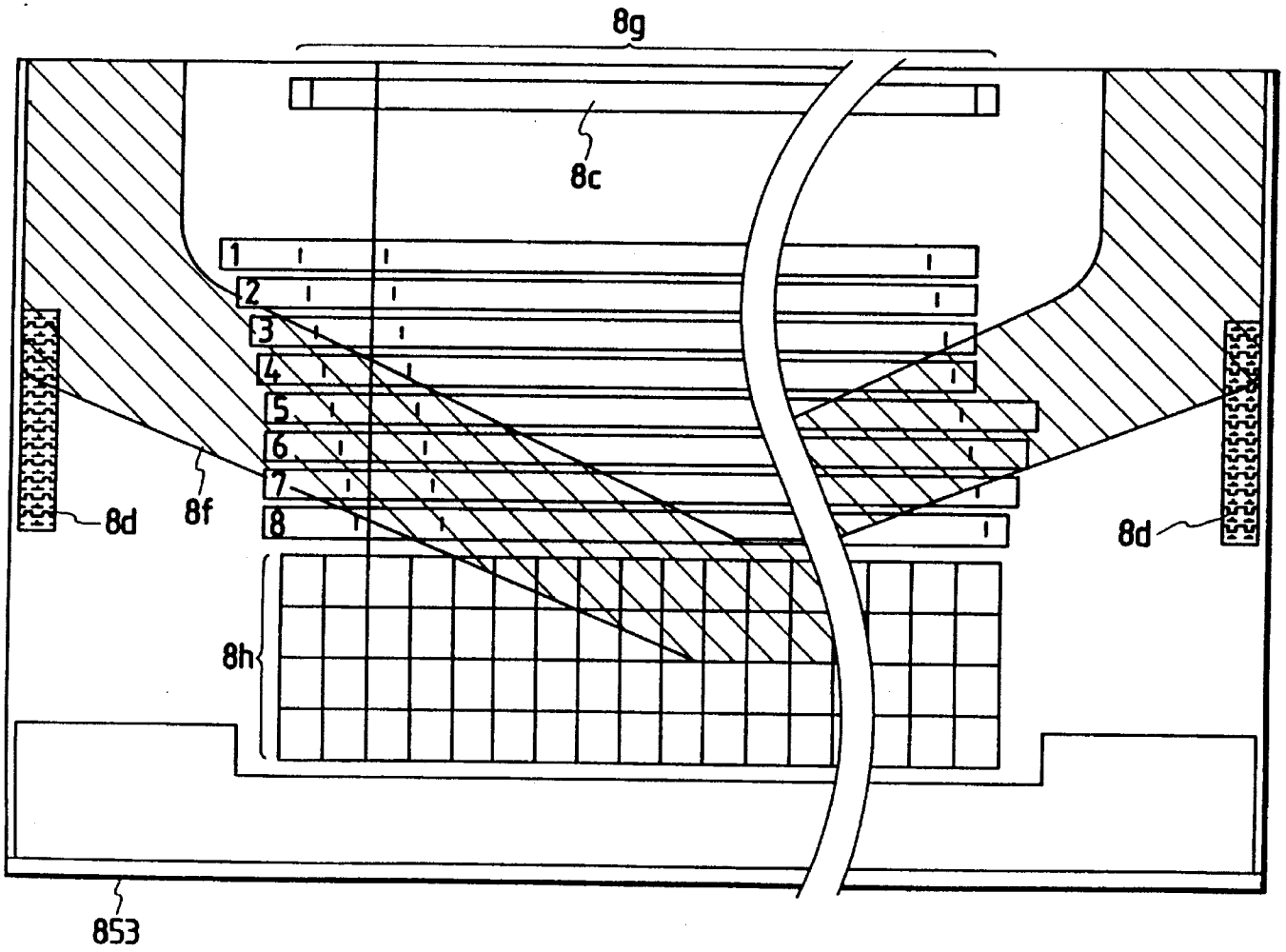
FIG. 3 is a view for explaining a heater board.

FIG. 3 illustrates the heater board 100 of the head used in this embodiment. Temperature control (sub) heaters 8*d* for controlling the temperature of the head, an ejection portion array 8*g* in which ejection (main) heaters 8*c* for ejecting an ink are arranged, and driving elements 8*h* are formed on a single substrate to have the positional relationship shown in FIG. 3. When the elements are arranged on the single substrate in this manner, the head temperature can be efficiently detected and controlled, and furthermore, a compact structure and a simple manufacturing process of the head can be attained. FIG. 3 also illustrates the positional relationship of an outer peripheral wall section 8*f* of the top plate for separating a region where the heater board is filled with ink from the remaining region. A portion, at the side of the ejection heaters 8*c*, of the outer peripheral wall section 8*f* of the top plate serves as the common ink chamber. Note that grooves formed on the outer peripheral wall section 8*f* of the top plate above the ejection portion array 8*g* define nozzles.

(v) Description of Control Arrangement

The control arrangement for executing recording control of the respective sections of the above-mentioned apparatus arrangement will be described below with reference to the block diagram shown in FIG. 4. A control circuit shown in FIG. 4 includes an interface 10 for inputting a recording signal, an MPU 11, a program ROM (PROM) 12 for storing a control program executed by the MPU 11, and a dynamic RAM (DRAM) 13 for storing various data (the recording signal, recording data supplied to the head, and the like). The control circuit also includes a gate array 14 for performing supply control of recording data to a recording head 18, and also performing data transfer control among the interface 10, the MPU 11, and the DRAM 13, a carrier motor 20 for conveying the recording head 18, a convey motor 19 for conveying a recording sheet, a head driver 15 for driving the head, and motor drivers 16 and 17 for respectively driving the convey motor 19 and the carrier motor 20.

Figure 4:
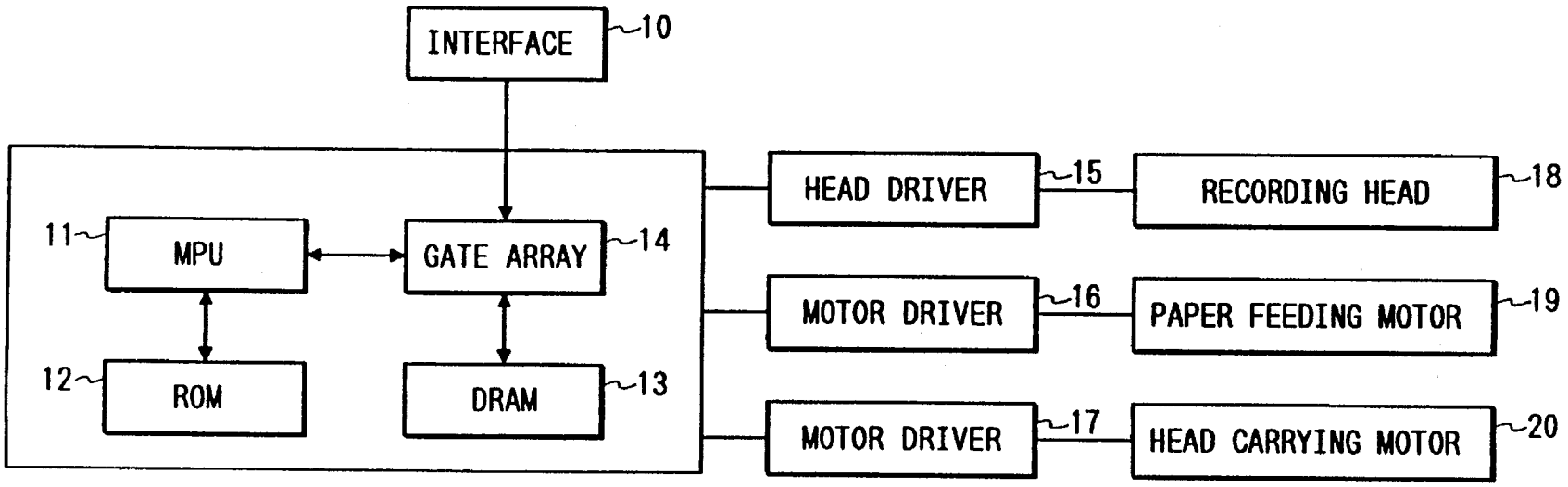
FIG. 4 is a block diagram showing a control circuit according to an embodiment of the present invention.
Figure 5:
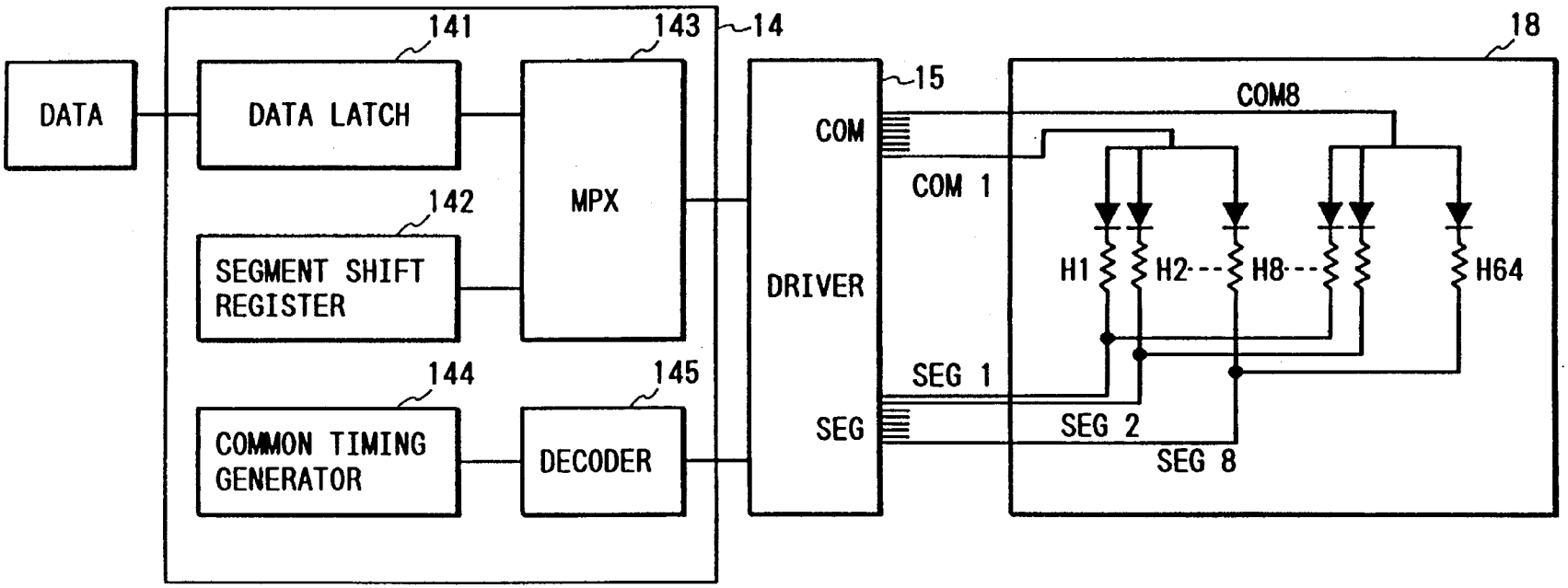
FIG. 5 is a block diagram showing details of the control arrangement shown in FIG. 4.

FIG. 5 is a circuit diagram showing details of the respective sections of FIG. 4. The gate array 14 has a data latch 141, a segment (SEG) shift register 142, a multiplexer (MPX) 143, a common (COM) timing generator 144, and a decoder 145. The recording head 18 has a diode-matrix arrangement. That is, a driving current flows at an ejection heater (H1 to H64) at a position where a common signal COM and a segment signal SEG coincide with each other, thus heating and ejecting an ink.

The decoder 145 decodes a timing signal generated by the common timing generator 144 to select one of common signals COM1 to COM8. The data latch 141 latches recording data read out from the DRAM 13 in units of 8 bits. The multiplexer 143 outputs the recording data latched by the latch 141 as segment signals SEG1 to SEG8 according to the segment shift register 142. The output from the multiplexer 143 can be variously changed like a 1-bit output, a 2-bit output, an 8-bit output, and the like according to the content of the shift register 142, as will be described later.

The operation of the control arrangement will be described below. When a recording signal is input to the interface 10, the recording signal is converted into print recording data between the gate array 14 and the MPU 11. The motor drivers 16 and 17 are driven, and the head is driven according to the recording data supplied to the head driver 15, thus performing a printing operation.

Prior to the description of this embodiment, problems in a conventional driving method will be described in detail below.

Figure 6A:
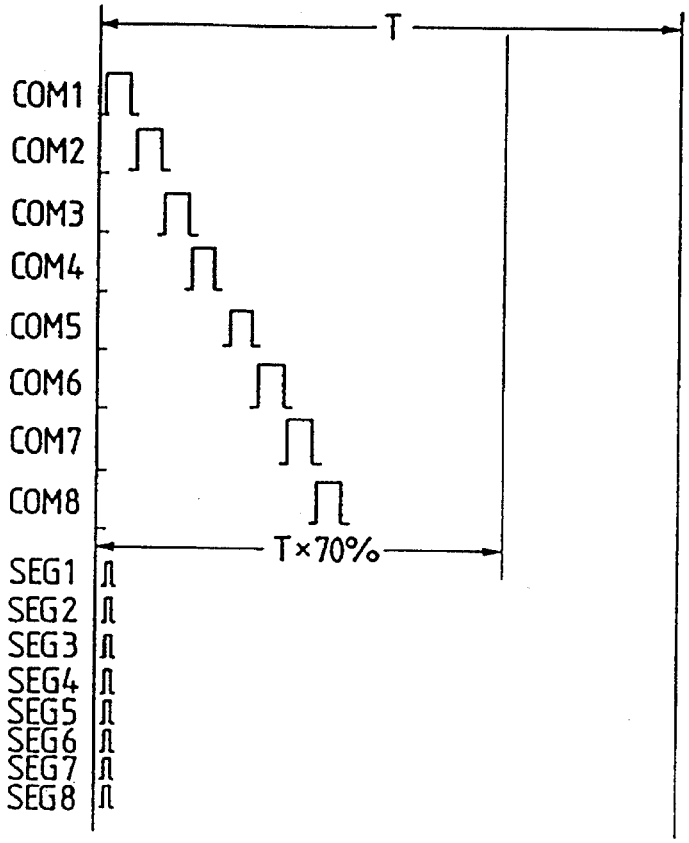
FIG. 6A PRIOR ART
FIGS. 6A and 6B are respectively a timing chart and a graph for explaining a conventional driving method of a recording head.
Figure 6B:
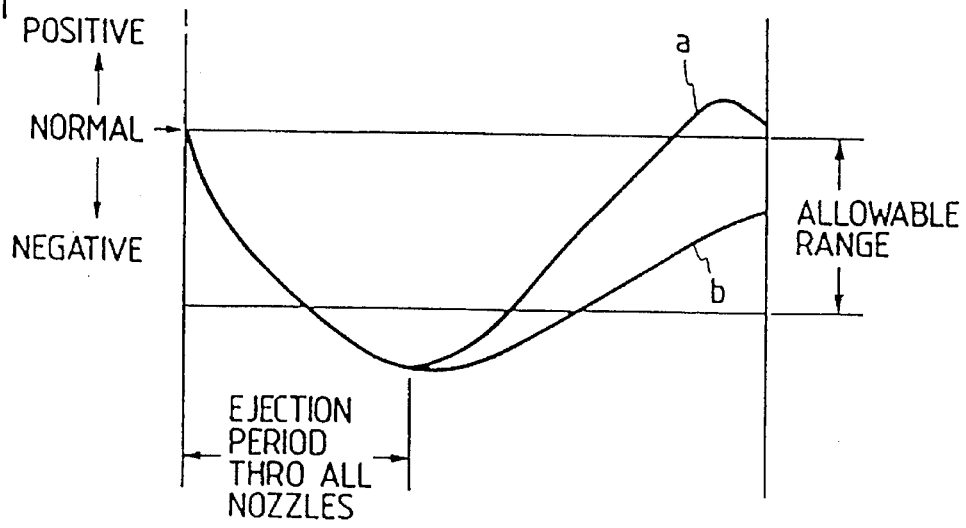
FIG. 6B PRIOR ART
Figure 7:
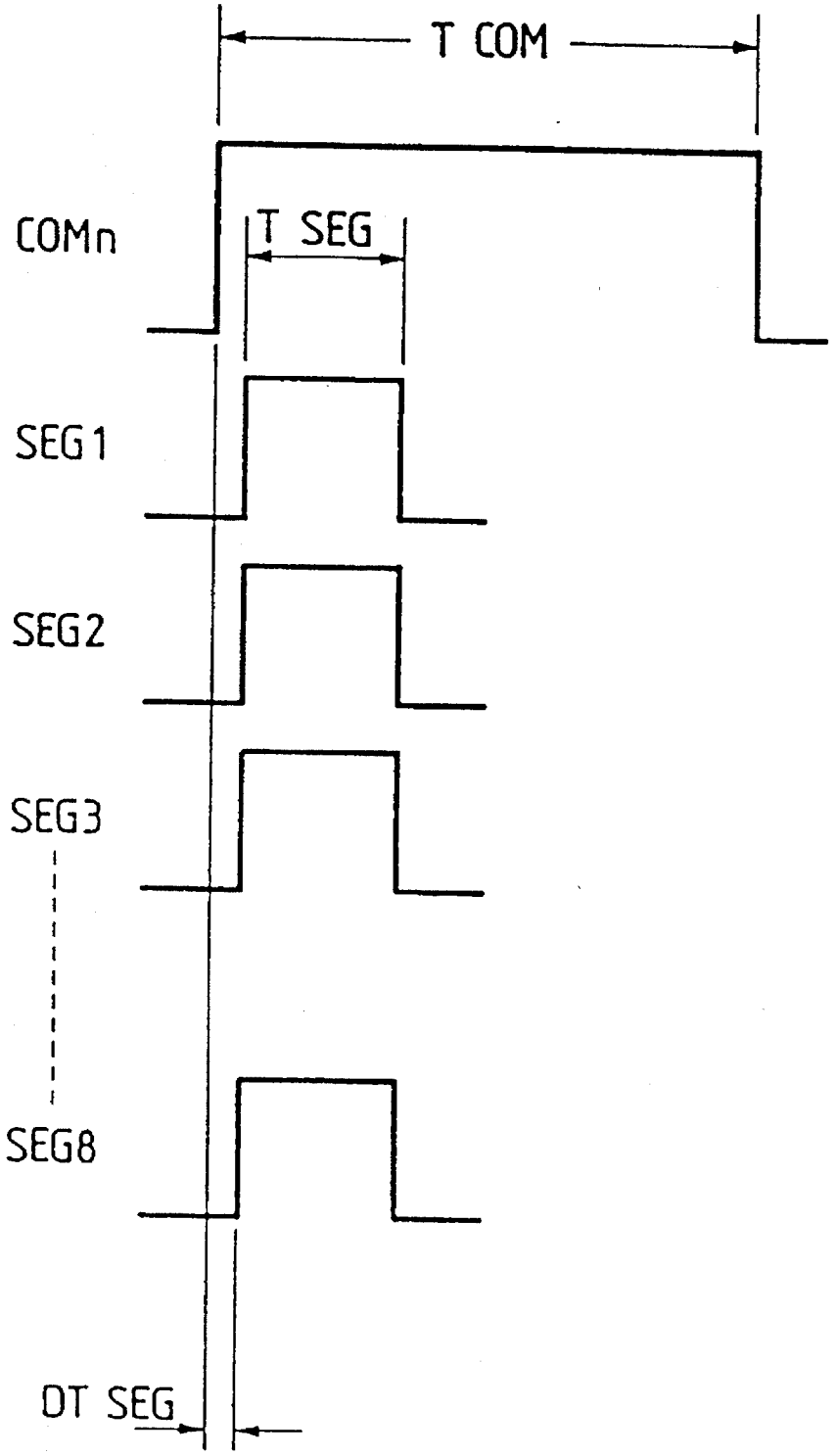
FIG. 7 PRIOR ART
FIG. 7 is a timing chart showing details of segment signals SEG1 to SEG8 in an n-th common signal COMn in FIG. 6A.

FIGS. 6A and 6B are respectively a timing chart of driving pulses according to the conventional recording head driving method, and a graph showing a pressure state in the common ink chamber at that time. FIG. 7 is a timing chart showing details of the segment signals SEG1 to SEG8 in an n-th common signal COMn shown in FIG. 6A.

The common and segment terminals of heaters are connected in units of 8 bits like the heaters H1 to H64 shown in FIG. 5. As for the heaters for which segment signals SEG go to high level at the same time, as shown in FIG. 6A, nozzles corresponding to heaters for which a signal COM1 goes to high level and the signals SEG go to high level start ejection. This ejection operation is repeated for a short period of time from signals COM2 and COM3 to a signal COMB, thus completing ejection operations of 64 nozzles. In this case, a time up to the end of ejection from the first nozzle to the last nozzle (all the nozzles capable of performing ejection) is about 40% of an ejection period T. This is to cause all of a plurality of nozzles to perform ejection for a period of time as short as possible, so that a vertical ruled line can be recorded as linearly as possible. The ejection (driving) period T means the shortest period in which a given nozzle is subjected to ejection driving.

However, under such circumstances, an ejection error caused by a printing pattern and refill characteristics of an ink frequently occurs.

For example, a case will be examined below wherein a vertical ruled line consisting of a continuous 2-dot array is to be printed. In a state wherein the first dot of a vertical ruled line is being printed, since a printing operation is started from a state wherein the ink is refilled in nozzles, all the nozzles can perform normal ejection. However, thereafter, it is found that nozzle states during and after ejection have a large difference. When the second dot of the ruled line is successively printed, since refill states of the first dot vary depending on nozzles, the nozzles present different nozzle conditions.

More specifically, since most nozzles do not complete a refill operation in the latter half of ejection of the second dot, the dot size is decreased or a main droplet cannot be formed at all due to a decrease in ejection quantity, thus performing a so-called splash-like undesirable discharge. Note that it is also found that when the third and fourth dots are further printed, the generation probability of this phenomenon is gradually decreased. When ejection is performed at a frequency equal to or higher than a critical frequency of conventional control, an undesirable discharge state occurs in many nozzles in printing operations of the second and subsequent dots.

Figure 8A:
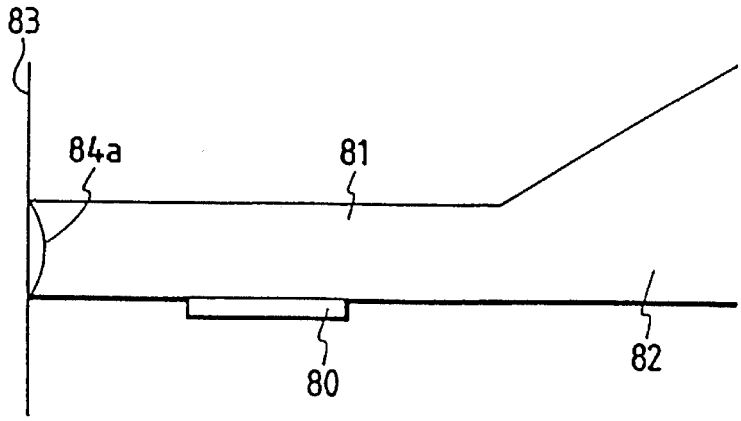
FIG. 8A PRIOR ART
FIGS. 8A to 8C are views showing a nozzle portion of a recording head and a state of the meniscus of an ink formed at the nozzle distal end portion.
Figure 8B:
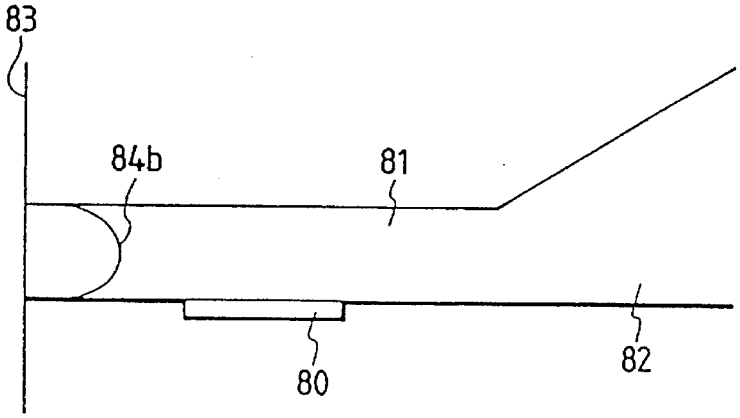
FIG. 8B PRIOR ART
Figure 8C:
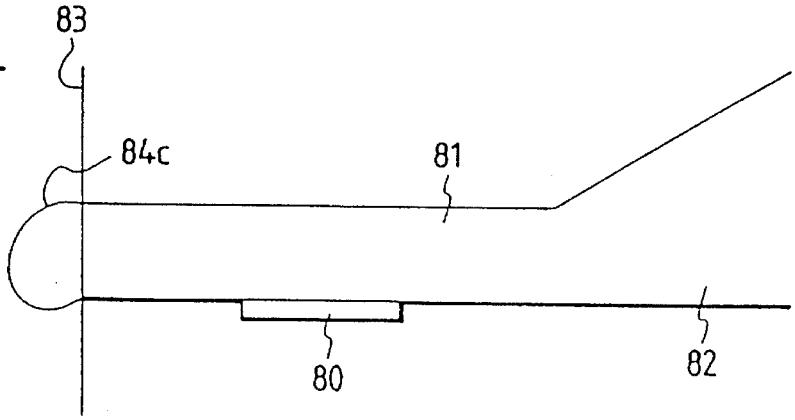
FIG. 8C PRIOR ART

The above-mentioned state will be explained below with reference to FIGS. 8A to 8C. FIGS. 8A to 8C are sectional views of a nozzle portion, and show a nozzle portion of a recording head, and a state of the meniscus of the ink formed at the distal end portion of the nozzle. FIGS. 8A to 8C illustrate an ejection heater 80, a nozzle (flow path or passage) 81, a common ink chamber 82, an orifice plate 83, and a meniscus 84. In the state shown in FIGS. 6A and 6B, a normal meniscus shape 84*a* (FIGS. 8A) of the ink can no longer be formed at the distal end of an ejection nozzle. When the negative pressure is too high or when a refill operation is not in time at the beginning of the next ejection period, a state shown in FIG. 8B is formed. On the contrary, when an oscillation does not converge, and a positive pressure is generated, a meniscus shape 84*c* of the ink projects from the end face of the recording head, as shown in FIG. 8C. When ejection is performed in such states, the dot size is decreased or a main droplet cannot be formed at all due to a decrease in ejection quantity in FIG. 8B, and a so-called splash-like undesirable discharge is performed. When ejection is started in the state shown in FIG. 8C, the ink projecting from the end face is pushed by the ink receiving a forward moving force in the nozzle 81, it is conically scattered in a mist form in every direction.

The above-mentioned problems are directly caused by a refill error, as described above. The refill error is caused by a cause system to be described below.

As one cause, a force necessary for moving the ink present in the ink tank to the ejection nozzle does not easily act due to an inertial force acting to cause the ink to stay still, and the interior of the common ink chamber further becomes a negative pressure state. As a result, the meniscus recess quantity is increased, or the refill speed is decreased.

Figure 9:
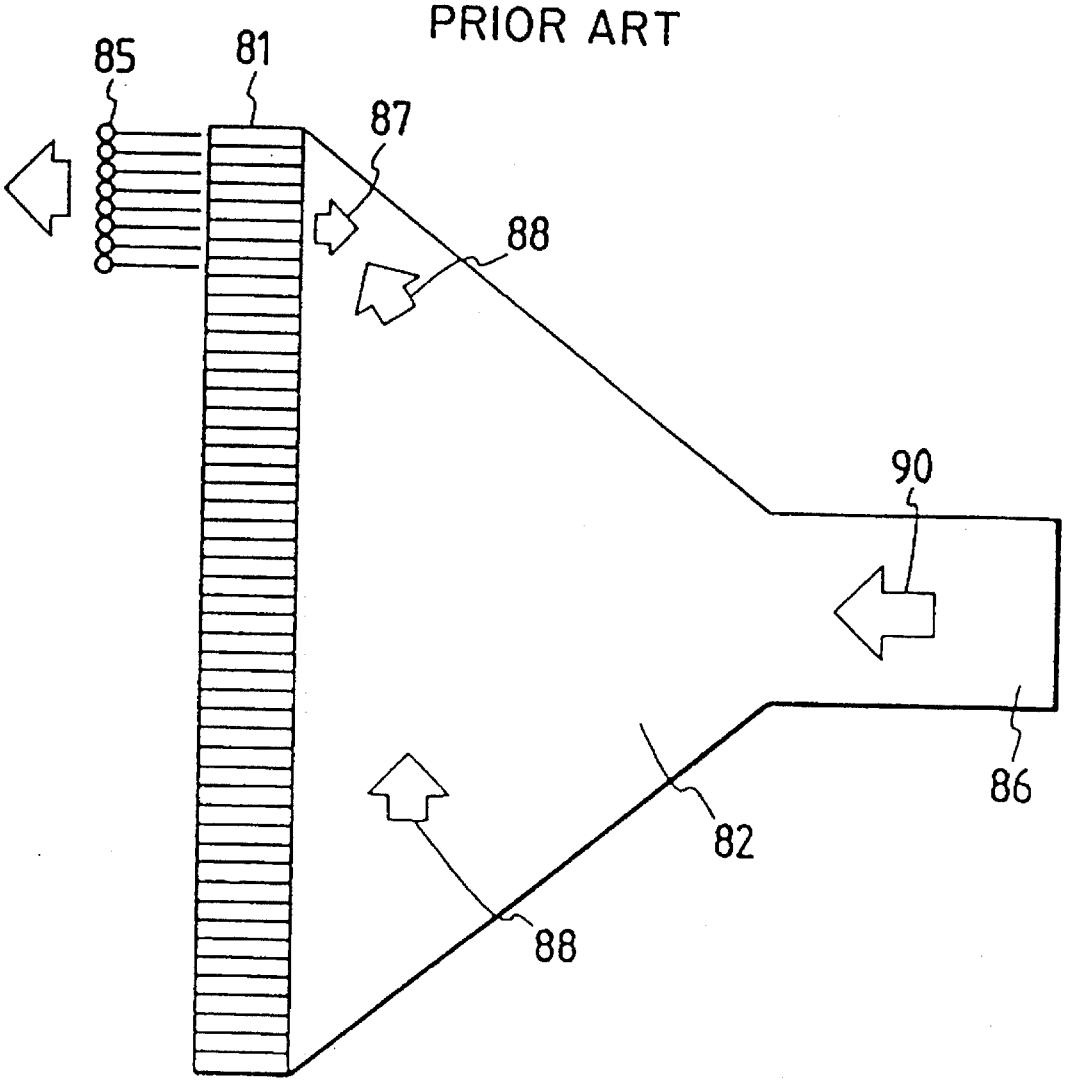
FIG. 9 PRIOR ART
FIG. 9 is a view for explaining the flow of an ink in a common ink chamber.

A mechanism for generating a negative pressure will be described in more detail with reference to FIG. 9. FIG. 9 is an explanatory view showing the flow of an ink near the common ink chamber. When ejection is performed at a possibly maximum driving period, it is assumed that the principle of generation of a negative pressure in the common ink chamber in the early stage of ejection is roughly based on the following two points:

① a flow 88 generated by a capillary force generated to refill ink 85 ejected from a nozzle 81, and to pull the ink from a common ink chamber 82 toward the nozzle 81 side; and ② a reverse flow force 87 generated since the ink is pushed back from the nozzle 81 into the common ink chamber 82 by bubble generation energy toward the common ink chamber 82 upon generation of a bubble.

Note that 90 designates an ink supply power.

At this time, when the nozzle 81 starts ejection, the reverse flow force 87 is generated by an ejection reaction. The pressure in the common ink chamber is temporarily increased in the positive pressure direction to push the meniscus due to the reverse flow force 87. Thus, ink supply from the ink supply appears to be temporarily stopped. Thereafter, when a refill operation of the nozzle, which has already ejected the ink, is started in the latter half of ejection in the same ejection period, the ink near the nozzle begins to be drawn into the nozzle. However, movement of a large mass of the overall ink including that in the tank is slow due to the above-mentioned inertial force, and the interior of the common ink chamber 82 is set in an excessive negative pressure state.

A change in pressure in the common ink chamber at this time exceeds an allowable level of an optimal ejection state in nozzles, which perform ejection in the latter half, of 64 nozzles, as shown in FIG. 6B. Since ejection is concentrated in a short period of time, the ink is ejected at a speed higher than the supply speed of the ink from the ink tank, and the negative pressure in the common ink chamber becomes higher than the allowable level.

In this state, the latter half nozzles, which perform ejection at the above-mentioned timing, suffer from a considerable decrease in meniscus recess quantity after ejection or refill speed. In practice, an excessive negative pressure is apparently compensated for and eliminated by an excessive recess of the meniscus or a decrease in refill speed. However, consequently, the problem of the above-mentioned excessive recess of the meniscus or decrease in refill speed remains unsolved.

Therefore, since the first dot presents such refill characteristics, an undesirable discharge easily occurs in the latter half nozzles in ejection of the second dot due to an insufficient refill quantity. When a case wherein a vertical ruled line consisting of continuous three or four dots is to be printed in place of a 2-dot line is observed, it is found that a probability of an uneasy undesirable discharge is high. This is because the above-mentioned inertial force for causing an ink to stay still is decreased since the ink begins to move, and an increase in negative pressure, which disturbs a refill operation, is increased.

As a second cause system, the ink in the ink tank is unbalanced. The reverse flow force ② for pushing back the ink in the common ink chamber 82 toward the ink tank is generated only when a force exceeding a force for causing the ink in the common ink chamber 82 to stay therein is applied. More specifically, the reverse flow force ② is generated only when a force for pushing back the ink in the common ink chamber 82 toward the ink tank exceeds a force such as a frictional load/inertial load/viscosity resistance in the common ink chamber 82. In this case, the negative pressure in the common ink chamber 82 is undesirably increased.

When ejection is further continued, since the ink in the ink tank is unbalanced, a negative pressure in the tank is increased, and the negative pressure of the ink to be supplied to the common ink chamber 82 is steadily increased. For this reason, the level of the negative pressure in the common ink chamber 82 becomes always high, and easily deviates from an allowable negative pressure range when the quantity of the ink to be ejected per unit time is large. In particular, in the latter half of all the ejection nozzles, the negative pressure level becomes very high, and an ejection error such as an undesirable discharge is apt to occur.

Referring back to FIGS. 6A and 6B, a head presenting pressure characteristics b in FIG. 6B has a lower ink refill speed than a driving period T. A head presenting pressure characteristics a has characteristics capable of refilling the ink in nozzles once. However, an oscillation does not converge, and the pressure in the common ink chamber becomes positive at the end of an ejection period. Note that different variations in negative pressure depending on heads are mainly caused by the nozzle length or viscosity of an ink.

Figure 10:
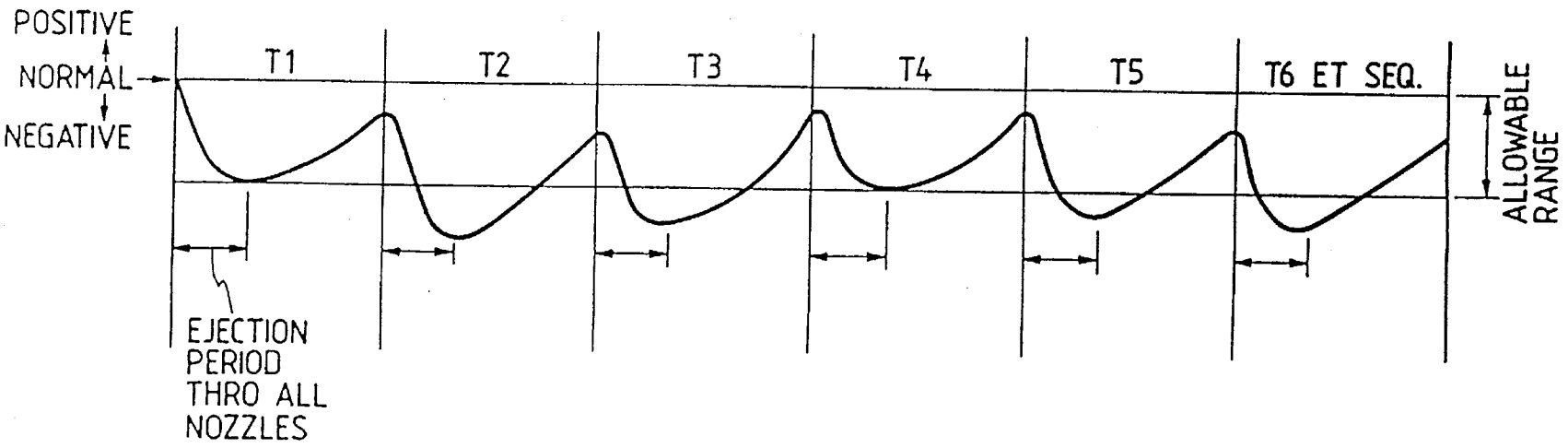
FIG. 10 PRIOR ART
FIG. 10 is a graph showing a change in pressure in the common ink chamber when continuous ejection is performed at a frequency near a conventional maximum driving frequency.

FIG. 10 shows a negative pressure state in the common ink chamber when continuous ejection is performed in a state near a minimum ejection period in the prior art. Ejection is continuously performed in units of 64 nozzles as periods T1, T2, T3, . . . , T64. During the first period T1, since the negative pressure level in the common ink chamber upon ejection at the first nozzle indicates normal pressure (a pressure statically balanced in the common ink chamber), a negative pressure upon ejection at the 64th nozzle marginally falls within an allowable range. During the second period T2, since a negative pressure upon ejection at the first nozzle is already considerably lowered, a negative pressure upon ejection at about the 30th nozzle exceeds the allowable pressure range. In this state, since the remaining 34 nozzles perform ejection while the meniscus is considerably recessed, an ejection error such as a decrease in dot size, an undesirable discharge, or the like is apt to occur.

During the fourth period, since an inertial force for flowing the ink in the ink tank or the common ink chamber in the nozzle direction due to ejection is gradually increased, the negative pressure level is slightly improved, and normal ejection of 64 nozzles can be marginally enabled. However, when continuous ejection is further continued, a negative pressure is gradually increased due to a balance of the ink in the ink absorbing member in the ink tank. Thus, since a refill operation of the ink into the common ink chamber is not in time again, the negative pressure level is increased beyond the allowable level in the latter half of ejection, and the above-mentioned ejection error occurs, as shown in the ejection periods T5 and T6.

According to the present invention, as a result of the above-mentioned examinations by the present inventors, it was found that when the number of nozzles which attain a maximum bubble generation pressure at the same timing was limited, and a time required for completing ejection of all the ejection enabled nozzles was prolonged as much as possible, ejection was stabilized. More specifically, the quantity of the ink ejected per unit time is decreased to suppress an increase in negative pressure level in the common ink chamber. Since the amplitude of a variation in negative pressure is decreased, an oscillation can be converged earlier, and consequently, the interior of the common ink chamber can always be maintained at an optimal negative pressure level.

In this manner, the meniscus can be prevented from being extremely recessed to prevent an excessive negative pressure, thereby reducing a delay of the refill operation.

[First Embodiment]

Figure 11A:
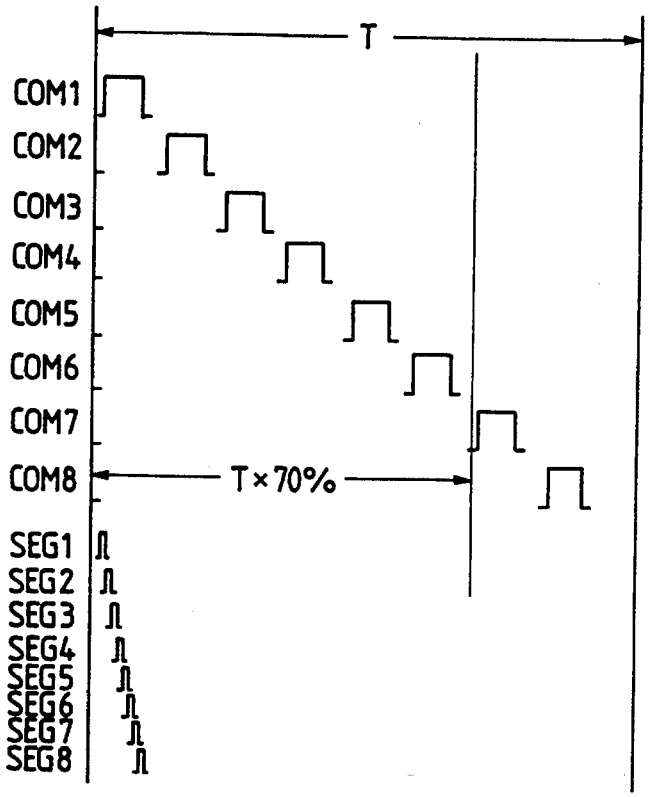
FIGS. 11A and 11B are respectively a timing chart and a graph for explaining a driving method of a recording head according to this embodiment.
Figure 11B:
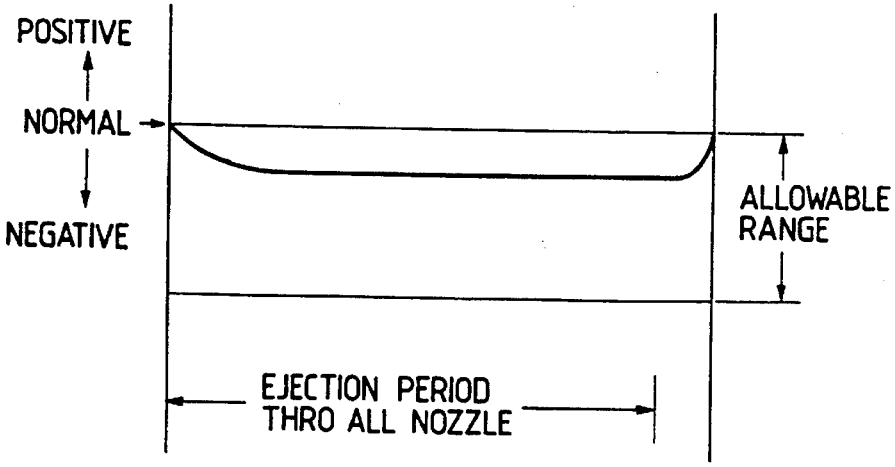
Figure 12:
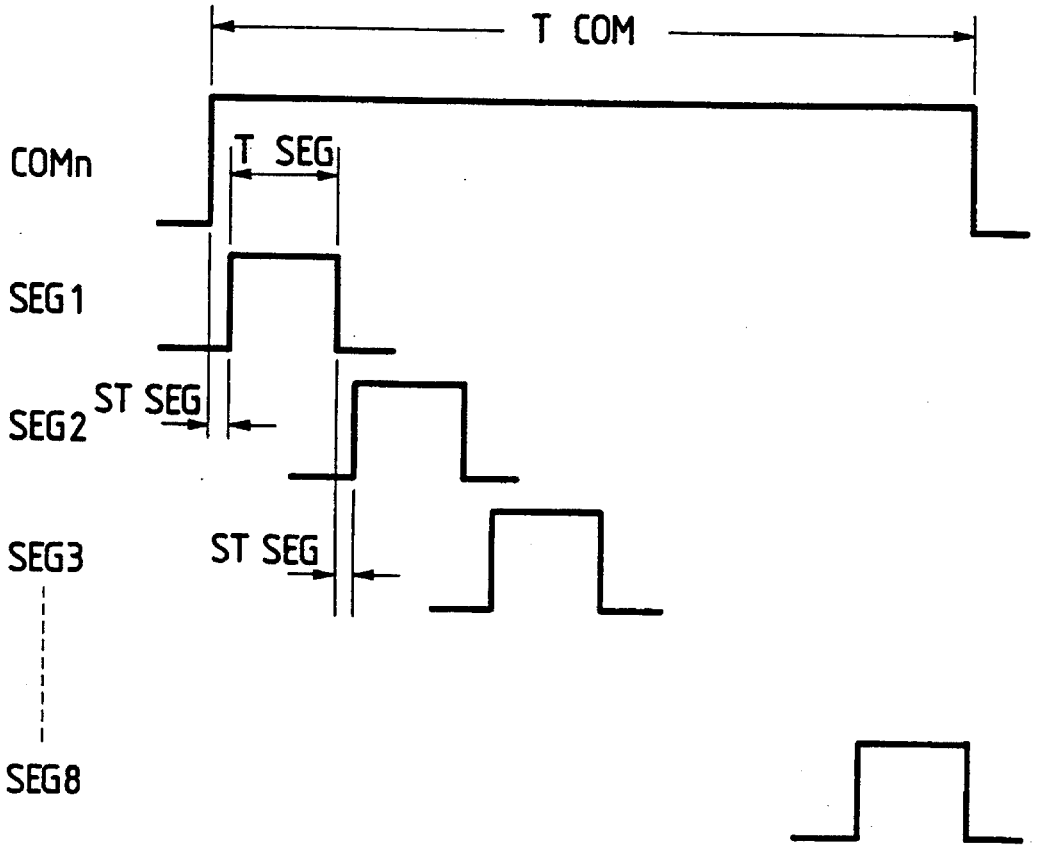
FIG. 12 is a timing chart showing details of segment signals SEG1 to SEG8 in an n-th common signal COMn in FIG. 11A.

The first embodiment of the present invention will be described below with reference to FIGS. 11A to 12. FIG. 11A is a timing chart of driving pulses according to a recording head driving method of this embodiment, and FIG. 11B is a graph showing a pressure state in the common ink chamber at that time. FIG. 12 shows details of segment signals SEG1 to SEG8 in an n-th common signal COMn in FIG. 11A. In this embodiment, a signal output method is different from that in the prior art shown in FIGS. 6A to 7, and the output timings of segment signals SEG are sequentially shifted one by one. Thus, only one nozzle performs ejection at a single timing. Furthermore, since common signals COM are originally shifted like in the prior art, ejection heaters H1 to H64 sequentially cause nozzles to perform ejection one by one.

More specifically, as shown in FIG. 12, after an elapse of a predetermined delay time STSEG at the leading edge of a given common signal COMn, a segment signal SEG1 goes to high level. Upon an elapse of a predetermined ejection pulse width TSEG, a signal SEG2 goes to high level similarly after an elapse of a delay time STSEG. Thereafter, this operation is similarly repeated up to SEG8. In this embodiment, for the sake of easy understanding of the timings, the segment signals SEG1 to SEG8 are shifted so as not to overlap each other at all. In accordance with the idea of the present invention, it is important that maximum points of a bubble generation pressure generated by these pulse currents are not attained at the same timing. For example, the number of nozzles may be large, and some segment signals may overlap each other in a single common signal.

In this embodiment, ejection is performed as described above. It is more important herein that when all the ejection enabled nozzles are subjected to ejection within an ejection period T, ejection is performed so that a time required for completing ejection from the first nozzle to the last nozzle (64th nozzle) becomes about 90% of the ejection period T. As can be seen from a change in pressure in the common ink chamber in the recording head shown in FIG. 11B, when ejection according to this embodiment is performed, a negative pressure in the common ink chamber can fall within an allowable range so as not to adversely influence ejection. A pressure waveform in the common ink chamber shown in FIG. 11B particularly represents a pressure near nozzles to be subjected to ejection.

Figure 13:
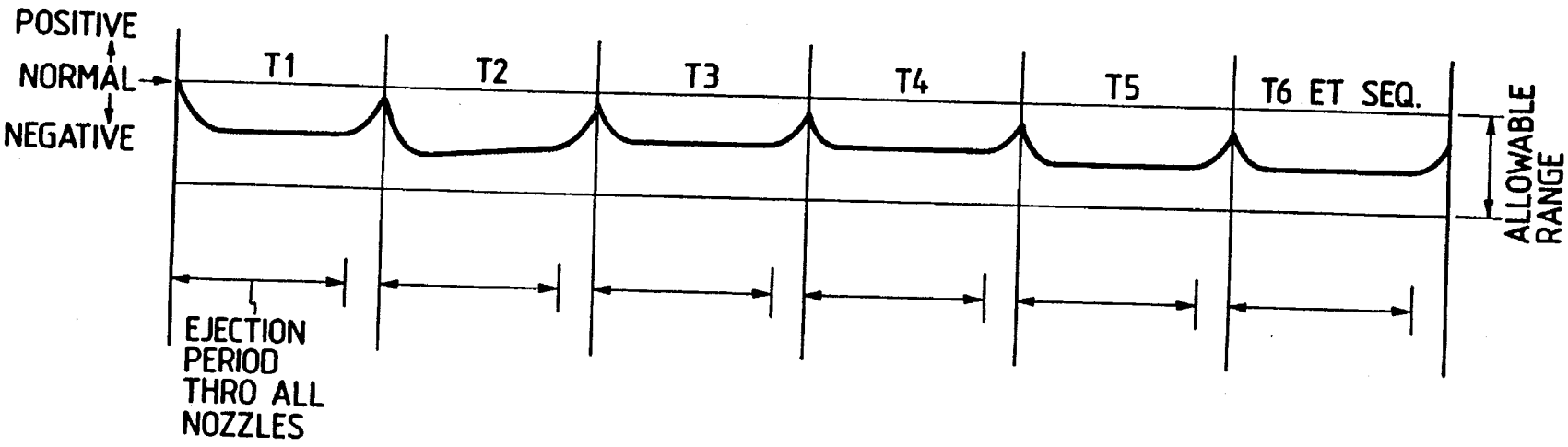
FIG. 13 is a graph showing a change in pressure in the common ink chamber when continuous ejection is performed at a frequency near a maximum driving frequency in this embodiment.

FIG. 13 shows a change in pressure in the common ink chamber when heaters are driven according to this embodiment at the same driving frequency as in the prior art shown in FIG. 10. As can be seen from FIG. 13, when continuous ejection is performed, a variation in negative pressure based on the same principle as in the above-mentioned prior art occurs in a qualitative sense. However, since the absolute value and oscillation of the negative pressure can be remarkably reduced in this embodiment, the negative pressure level will never exceed an allowable range, and ejection can be stably performed.

In this embodiment, ejection is performed as described above. The present inventors experimentally confirmed that when all the ejection enabled nozzles were subjected to ejection within an ejection period T, if ejection was performed so that a time required for completing ejection from the first nozzle to the last nozzle (64th nozzle) became about 70% or more of the ejection period T, a negative pressure in the common ink chamber could fall within an allowable range so as not to adversely influence ejection. This will be described below with reference to FIGS. 14A and 14B.

Figure 14A:
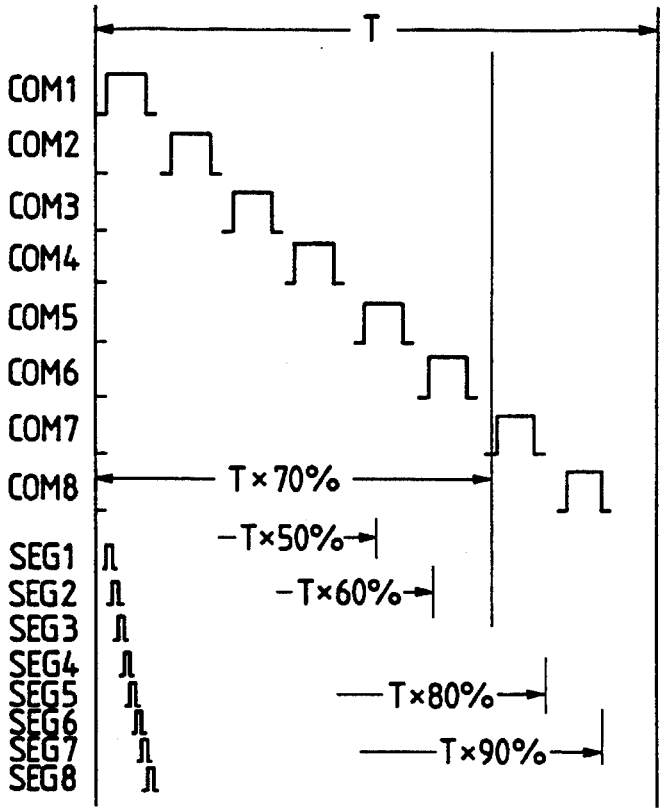
FIGS. 14A and 14B are respectively a timing chart and a graph showing a change in pressure in the common ink chamber when a time to the end of ejection from the first nozzle to the last nozzle is changed.
Figure 14B:
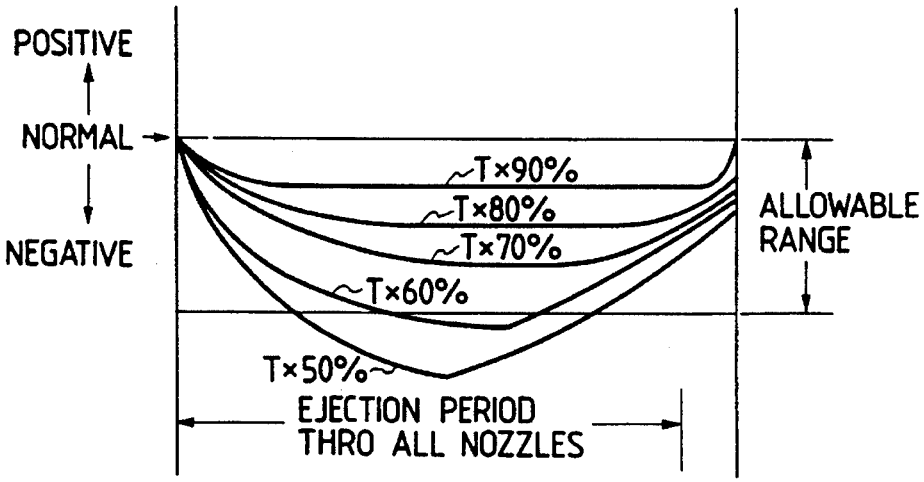

FIG. 14A is a timing chart showing timings of segment signals SEG and common signals COM, and FIG. 14B is a graph showing variations in pressure in the common ink chamber obtained when a time required for completing ejection from the first nozzle to the last nozzle is set to be 50%, 60%, 70%, 80%, and 90%, respectively. As can be apparent from FIG. 14B, a negative pressure in the common ink chamber exhibits a variation in pressure: the negative pressure is increased simultaneously with the beginning of ejection, and then returns to normal pressure after the end of ejection. If the time until ejection is ended is shorter, the inclination of an increase in negative pressure is larger, and a maximum negative pressure is also larger. This is because if the quantity of an ink ejected per unit time is larger, the negative pressure level in the common ink chamber is higher.

As can be seen from the above description, the time until ejection of all the nozzles is ended is set to be 70% or more of the driving period.

As the above-mentioned test conditions, the recording head was driven at 3 kHz (333 μsec period), and the driving pulse width was set to be 4 μsec. As the ink, an ink containing about 90% of water, 7% of a solvent, and 3% of a dye was used. In addition, the driving voltage was set to be 24 V.

Using this recording head, the temperature of the head was controlled to be 30° C. using the temperature control heaters 8*d* at an environmental temperature of 23° C. At this time, all the ink tanks having the same structure were used, and the negative head pressure of the ink tank was adjusted, so that 20 mmAq were normal pressure at a static head.

[Second Embodiment]

In the first embodiment, common signals COM and segment signals SEG are output in the order from the first nozzle to the 64th nozzle or in the opposite order, that is, ejection is continuously performed.

Figure 15A:
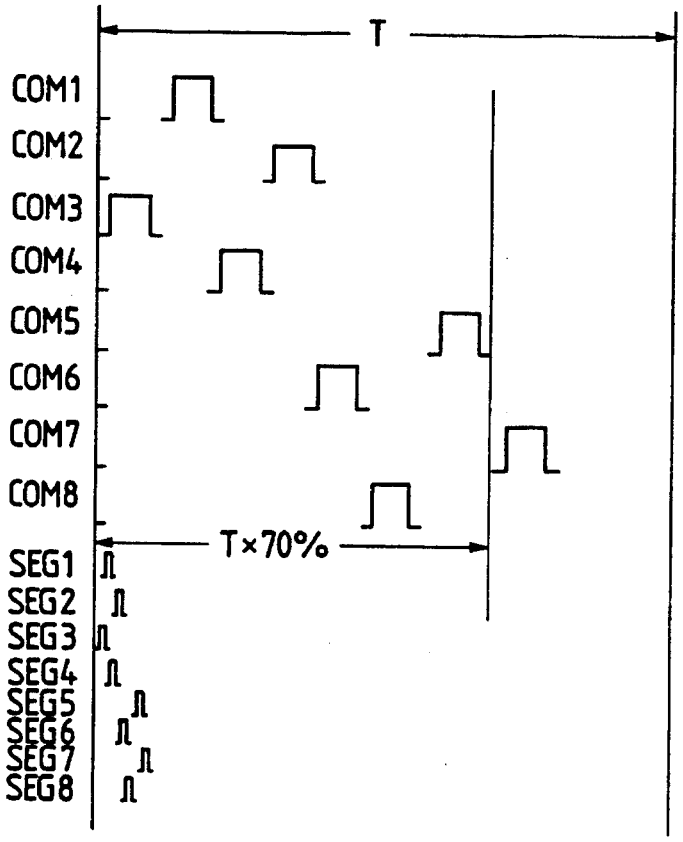
FIGS. 15A and 15B are respectively a timing chart and a graph for explaining the second embodiment of the present invention.
Figure 15B:
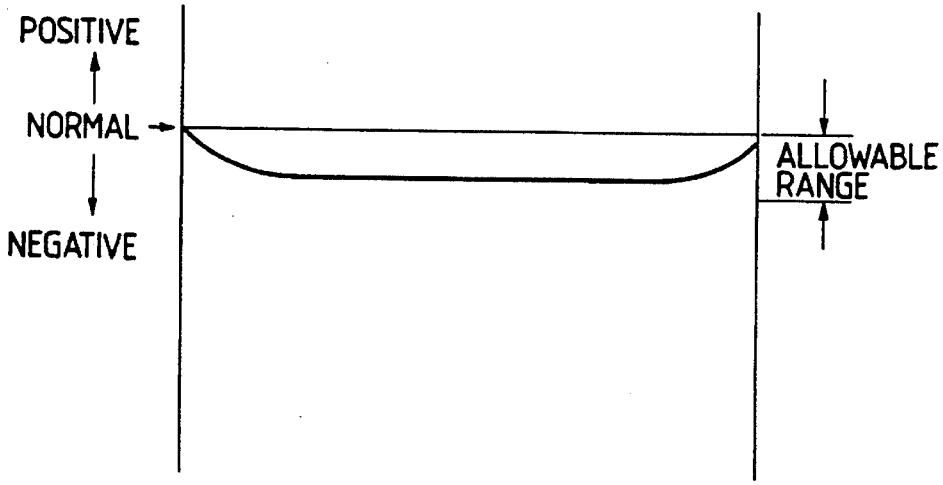

In the second embodiment shown in FIGS. 15A and 15B, an ink is inhibited from being ejected from adjacent nozzles at continuous timings. The idea for minimizing the number of nozzles which attain a maximum bubble generation pressure at the same timing, and for prolonging a time required for completing ejection of all the ejection enabled nozzles as much as possible is the same as in the first embodiment.

In this manner, pressure waves generated in the common ink chamber due to an ejection or refill operation can be randomly reflected. As a result, the amplitude caused by overlapping of pressure waves having the same vector can be suppressed. In principle, when ejection is performed at nozzles separated by at least one nozzle from each other, vectors having different propagation directions collide against each other to cancel the pressure waves. Thus, the maximum ejection frequency can be further increased.

Note that the arrangement and driving conditions of the recording head in this embodiment are the same as those in the first embodiment. In this embodiment, adjacent common signals COM are prevented from being output like in the segment signals SEG. However, adjacent common signals COM may be output like in the first embodiment.

According to this embodiment, an ink is inhibited from being ejected from adjacent ejection orifices so as to increase the degree of freedom of a flow-in direction of the ink flowing from the common ink chamber toward nozzles. Thus, this embodiment has an effect of simultaneously increasing an ink supply quantity to nozzle entrances. Furthermore, the refill speed can be increased by an oscillation damping effect and pulsation based on a difference between oscillation phases of the ink at adjacent nozzles. In particular, a refill improvement effect of other nozzles by an ejection reactive pressure wave is remarkably large.

[Third Embodiment]

In the first and second embodiments, all the nozzles, i.e., the first to 64th nozzles are driven at different timings to minimize the number of nozzles which attain a maximum bubble generation pressure at the same timing.

Figure 16:
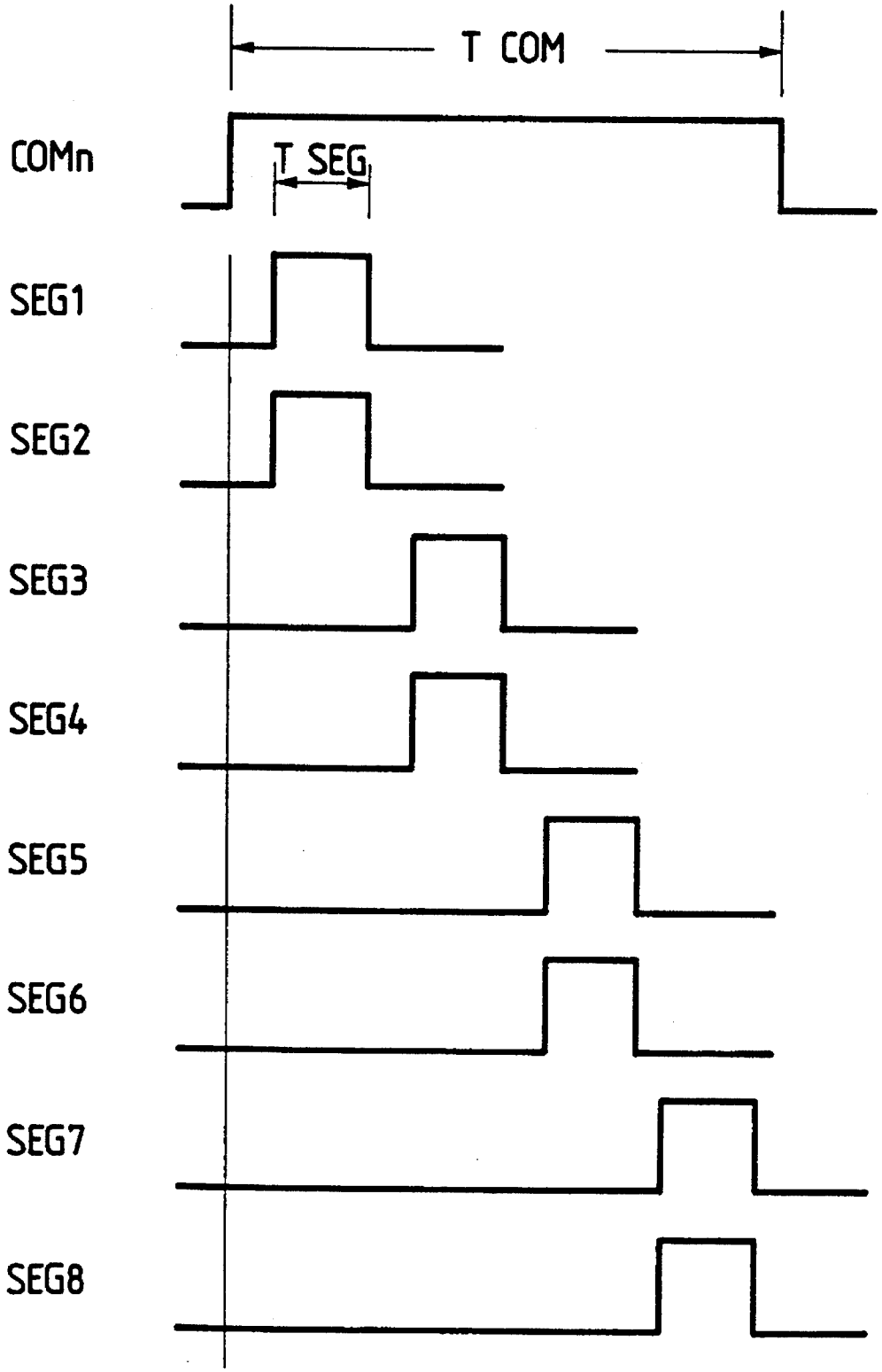
FIG. 16 is a timing chart for explaining the third embodiment of the present invention.

In the third embodiment shown in FIG. 16, two nozzles out of all the 64 nozzles are simultaneously driven. In this embodiment, ink ejection can be satisfactorily performed without increasing the negative pressure in the common ink chamber like in the first and second embodiments. On the other hand, in this embodiment, all the nozzles need not always be driven at different timings. The reason for this is as follows.

As described above, there are two generation causes of a dynamic negative pressure in the common ink chamber. However, when the quantity of the ink ejected per unit time is small, even when a dynamic negative pressure is generated, the negative pressure will not fall outside an allowable negative pressure range of ejection.

In this embodiment, since a period (an output period of common signals COM and segment signals SEG) required for driving in a driving period can be shortened as compared to the first and second embodiments, driving timings can be set to have a high degree of freedom. Note that the arrangement and driving conditions of the recording head in this embodiment are the same as those in the first embodiment.

[Fourth Embodiment]

The present inventors conducted further tests to develop the above embodiments, and confirmed that when an ejection quantity from nozzles driven at the same timing was 7% or less of an ejection quantity obtained when all the nozzles ejected an ink in the maximum quantity during almost the entire driving period, the above-mentioned ejection error did not occur.

The fourth embodiment will be described below with reference to test results shown in Tables 1 to 6 below. Table 1 shows a case wherein the ratio of a period required for completing ink ejection of all the nozzles to a driving period (see FIGS. 14A and 14B; to be referred to as a duty hereinafter) is 90%, and adjacent nozzles are not driven at continuous timings (see FIGS. 15A and 15B; to be referred to as a non-adjacent driving mode hereinafter). Table 2 shows an adjacent driving mode at a duty of 90%, Table 3 shows a non-adjacent driving mode at a duty of 70%, Table 3 shows a non-adjacent driving mode at a duty of 70%, Table 4 shows an adjacent driving mode at a duty of 70%, Table 5 shows a non-adjacent driving mode at a duty of 50%, and Table 6 shows an adjacent driving mode at a duty of 50%.

In the tables, x represents that the probability of generation of an ejection error is high, Δ represents that the probability of generation of an ejection error is low, ○ represents that the probability of generation of an ejection error is very low, and satisfactory recording can be performed, and ⊙ represents that very satisfactory recording can be performed. The state ○ was very scarcely observed when ink evaporation progressed and the ink viscosity was increased, or when an ink was used up. Numerical values in parentheses indicate the ratios of the number of nozzles which simultaneously perform ejection to the total number of nozzles.

TABLE 1

| | (90%, Non-adjacent Driving Mode) | | | | |
|---|---|---|---|---|---|
| | 1 | 2 | 4 | 8 | 16 |
| 8 | ○ (12.5%) | x (25.0%) | x (50.0%) | x (100.0%) | — |
| 16 | ⊙ (6.3%) | ⊙ (12.5%) | ○ (25.0%) | x (50.0%) | x (100.0%) |
| 32 | ⊙ (3.1%) | ⊙ (6.3%) | ⊙ (12.5%) | ○ (25.0%) | x (50.0%) |
| 64 | ⊙ (1.6%) | ⊙ (3.1%) | ⊙ (6.3%) | ⊙ (12.5%) | ○ (25.0%) |
| 128 | ⊙ (0.8%) | ⊙ (1.6%) | ⊙ (3.1%) | ⊙ (6.3%) | ⊙ (12.5%) |

TABLE 2

| | (90%, Adjacent Driving Mode) | | | | |
|---|---|---|---|---|---|
| | 1 | 2 | 4 | 8 | 16 |
| 8 | ○ (12.5%) | x (25.0%) | x (50.0%) | x (100.0%) | — |
| 16 | ⊙ (6.3%) | ⊙ (12.5%) | Δ (25.0%) | x (50.0%) | x (100.0%) |
| 32 | ⊙ (3.1%) | ⊙ (6.3%) | ⊙ (12.5%) | Δ (25.0%) | x (50.0%) |
| 64 | ⊙ (1.6%) | ⊙ (3.1%) | ⊙ (6.3%) | ⊙ (12.5%) | Δ (25.0%) |
| 128 | ⊙ (0.8%) | ⊙ (1.6%) | ⊙ (3.1%) | ⊙ (6.3%) | ⊙ (12.5%) |

TABLE 3

| | (70%, Non-adjacent Driving Mode) | | | | |
|---|---|---|---|---|---|
| | 1 | 2 | 4 | 8 | 16 |
| 8 | x (12.5%) | x (25.0%) | x (50.0%) | x (100.0%) | — |
| 16 | ⊙ (6.3%) | ○ (12.5%) | x (25.0%) | x (50.0%) | x (100.0%) |
| 32 | ⊙ (3.1%) | ⊙ (6.3%) | ○ (12.5%) | x (25.0%) | x (50.0%) |
| 64 | ⊙ (1.6%) | ⊙ (3.1%) | ⊙ (6.3%) | ○ (12.5%) | x (25.0%) |
| 128 | ⊙ (0.8%) | ⊙ (1.6%) | ⊙ (3.1%) | ⊙ (6.3%) | ○ (12.5%) |

TABLE 4

| | (70%, Adjacent Driving Mode) | | | | |
|---|---|---|---|---|---|
| | 1 | 2 | 4 | 8 | 16 |
| 8 | x (12.5%) | x (25.0%) | x (50.0%) | x (100.0%) | — |
| 16 | ⊙ (6.3%) | Δ (12.5%) | x (25.0%) | x (50.0%) | x (100.0%) |
| 32 | ⊙ (3.1%) | ⊙ (6.3%) | Δ (12.5%) | x (25.0%) | x (50.0%) |
| 64 | ⊙ (1.6%) | ⊙ (3.1%) | ⊙ (6.3%) | Δ (12.5%) | x (25.0%) |
| 128 | ⊙ (0.8%) | ⊙ (1.6%) | ⊙ (3.1%) | ⊙ (6.3%) | Δ (12.5%) |

TABLE 5

| | (50%, Non-adjacent Driving Mode) | | | | |
|---|---|---|---|---|---|
| | 1 | 2 | 4 | 8 | 16 |
| 8 | x (12.5%) | x (25.0%) | x (50.0%) | x (100.0%) | — |
| 16 | ○ (6.3%) | x (12.5%) | x (25.0%) | x (50.0%) | x (100.0%) |
| 32 | ⊙ (3.1%) | ○ (6.3%) | x (12.5%) | x (25.0%) | x (50.0%) |
| 64 | ⊙ (1.6%) | ⊙ (3.1%) | ○ (6.3%) | x (12.5%) | x (25.0%) |
| 128 | ⊙ (0.8%) | ⊙ (1.6%) | ⊙ (3.1%) | ○ (6.3%) | x (12.5%) |

TABLE 6

| | (50%, Adjacent Driving Mode) | | | | |
|---|---|---|---|---|---|
| | 1 | 2 | 4 | 8 | 16 |
| 8 | x (12.5%) | x (25.0%) | x (50.0%) | x (100.0%) | — |
| 16 | Δ (6.3%) | x (12.5%) | x (25.0%) | x (50.0%) | x (100.0%) |
| 32 | ⊙ (3.1%) | Δ (6.3%) | x (12.5%) | x (25.0%) | x (50.0%) |
| 64 | ⊙ (1.6%) | ⊙ (3.1%) | Δ (6.3%) | x (12.5%) | x (25.0%) |
| 128 | ⊙ (0.8%) | ⊙ (1.6%) | ⊙ (3.1%) | Δ (6.3%) | x (12.5%) |

As the conditions for the above-mentioned tests, each recording head was driven at 3 kHz (333 μsec period). The driving pulse width of a recording head sample manufactured for tests was set to be 4 μsec. As the ink, an ink containing about 90% of water, 7% of a solvent, and 3% of a dye was used. The head samples were manufactured to have a resolution of 45 DPI for an 8-nozzle head; 90 DPI for a 16-nozzle head; 180 DPI for a 32-nozzle head; 360 DPI for a 64-nozzle head; and 400 DPI for a 128-nozzle head. The sample heads had an ejection quantity per nozzle of 1,000 ng for an 8-nozzle head; 300 ng for a 16-nozzle head; 150 ng for a 32-nozzle head; 70 ng for a 64-nozzle head; and 40 ng for a 128-nozzle head. The driving voltage was set to be 24 V. The arrangement of the driving circuit was the same as that shown in FIGS. 4 and 5 described above, and was properly modified according to the numbers of nozzles of heads.

Using these recording heads, the temperature of the head was controlled to be 30° C. using the temperature control heaters 8*d* at an environmental temperature of 23° C. At this time, all the ink tanks having the same structure were used, and the negative head pressure of the ink tank was adjusted, so that 20 mmAq were normal pressure at a static head. In this state, a solid black (all ejection) pattern was printed, and the test results were judged based on printed states and ejection conditions of dots.

When the number of nozzles driven at the same timing is small, segment signals SEGs corresponding to the nozzles cannot be output without overlapping each other. A case will be described in detail below with reference to FIG. 12 wherein segment signals SEG overlap each other. A case will be exemplified below wherein the number of driving enabled nozzles of the recording head is 128, the number of segment signals SEG is 8, the number of common signals COM is 16, an ejection period T (a minimum driving period of the recording head) is 333 μsec (3 kHz), a heat time TSEG is 4 μsec, the driving period when all the nozzles are driven is 50% of the ejection period T, and all the nozzles are driven at different timings.

At this time, a time assigned to drive all the nozzles is 166 μsec (333 μsec*50%). Therefore, it is impossible to assure the heat time (TSEG) of 4 μsec of segment signals and to drive 128 nozzles at different timings within a time of 166 μsec. In this case, the driving time difference STSEG between segment signals shown in FIG. 12 is set to be −2.8 μsec, and a driving operation is performed while overlapping the segment signals. When the difference STSEG is set to be −2.8 μsec, since the heat time of the segment signals is 4 μsec, the next segment signal is enabled before the immediately preceding segment signal is disabled after an elapse of 2.2 μsec from when the previous segment signal is enabled. However, as described above, since the segment signals are not simultaneously enabled, even when the segment signals overlap each other, the maximum bubble generation points of nozzles do not overlap each other, and a desired effect can be obtained.

Upon examination of the above-mentioned test results, when the ratio of the driving period when all the nozzles are driven to the ejection period T remains the same, a correlation is found between the ratio of the number of nozzles simultaneously subjected to ejection and the boundary point between stable ejection and unstable ejection.

For example, the following facts can be derived from the result of a case wherein [the driving period when all the nozzles are driven is 70% of the ejection period T], and [common signals COM are output in the non-adjacent driving mode] in Table 3. When the ratio of the number of nozzles simultaneously subjected to ejection to the total number of nozzles is 6.3% or less, ejection is very satisfactorily performed regardless of the total number of nozzles and the number of nozzles simultaneously subjected to ejection of the recording head. When the ratio of the number of nozzles simultaneously subjected to ejection to the total number of nozzles is 25.0% or more, ejection is unstable regardless of the total number of nozzles and the number of nozzles simultaneously subjected to ejection of the recording head.

As an exception, when the ratio of the number of nozzles simultaneously subjected to ejection to the total number of nozzles is 12.5%, ejection is satisfactory except for a case wherein the total number of nozzles of the recording head is 8, and the number of nozzles simultaneously subjected to ejection is 1, while ejection is unstable when the total number of nozzles of the recording head is 8, and the number of nozzles simultaneously subjected to ejection is 1. As described in the test conditions, this is caused by a different simultaneous ejection quantity even when the ratio of the number of nozzles simultaneously subjected to ejection to the total number of nozzles remains the same. For example, when the total number of nozzles is 64, and the number of nozzles simultaneously subjected to ejection is 8, the simultaneous ejection quantity is 560 ng (=70 ng/dot*8), while when the total number of nozzles is 8, and the number of nozzles simultaneously subjected to ejection is 1, the simultaneous ejection quantity is 1,000 ng. For this reason, in the latter case, it can be considered that the simultaneous ejection quantity is large, and the magnitude of a negative pressure generated in the common ink chamber is large.

As can be understood from the above results, a non-sequential (non-adjacent) driving mode can stabilize ejection more easily than a sequential (adjacent) driving mode. The reason for this is as has been described above in the second embodiment.

Furthermore, as can be seen from Tables 1 and 2, at a duty of 90%, when the total number of nozzles is 16 or more, even if the ratio of the number of nozzles simultaneously subjected to ejection to the total number of nozzles is 12.5%, satisfactory ejection can be performed. As described above, when the total number of nozzles is large, even if the ratio of the number of nozzles simultaneously subjected to ejection to the total number of nozzles remains the same, the simultaneous ejection quantity can be decreased. Therefore, the magnitude of a negative pressure generated in the common ink cheer can be small.

As can be seen from Tables 5 and 6, satisfactory ejection can be performed at a duty of 50% in some cases. However, when the duty is set to be 70% or more, a further increase in driving frequency can be realized.

In this embodiment, a plurality of nozzles can be simultaneously subjected to ejection within a range of 7% of an ejection quantity obtained when all the nozzles are subjected to ejection in the maximum quantity. Thus, even in an apparatus which is difficult to drive all the nozzles at different timings due to a high-speed driving operation, the amplitude of refill oscillation can be minimized to stabilize ejection, and a further increase in driving frequency can be realized.

[Fifth Embodiment]

As a result of further analysis by the present inventors, we found another cause system that adversely influenced refill characteristics. This cause system is a steady problem, and the present inventors paid attention to the meniscus recess quantity. Although direct parameters are those of a variation in pressure in the common ink chamber, this problem occurs in a higher frequency region than the above-mentioned cause system. This problem will be examined below with reference to FIGS. 17A to 18C.

Figure 17A:
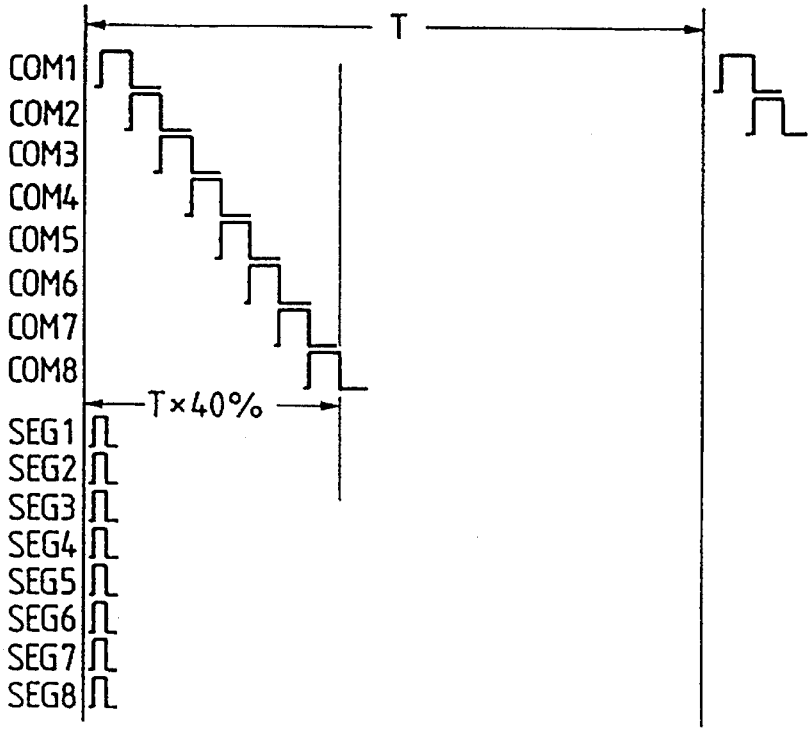
FIG. 17A PRIOR ART
FIGS. 17A and 17B are respectively a timing chart and a graph for explaining a conventional driving method of a recording head.
Figure 17B:
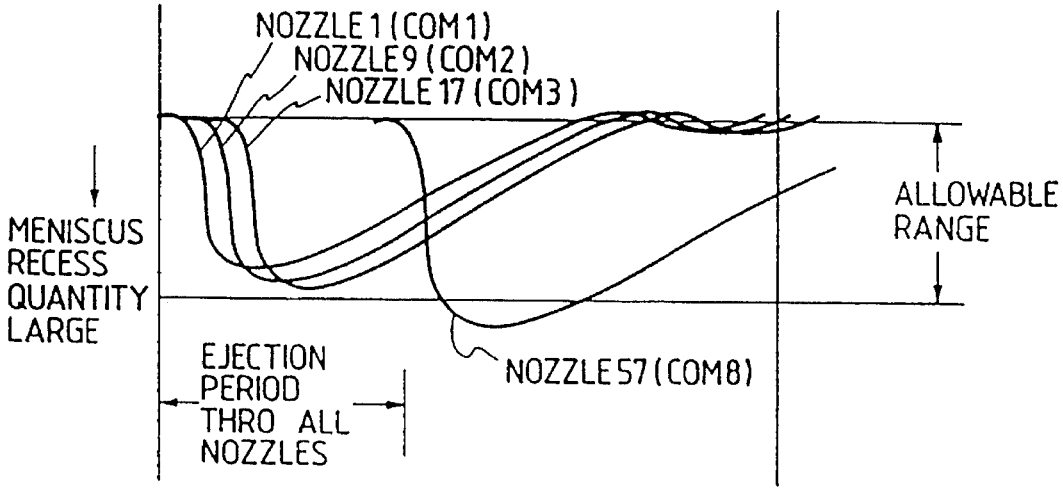
FIG. 17B PRIOR ART
Figure 18A:
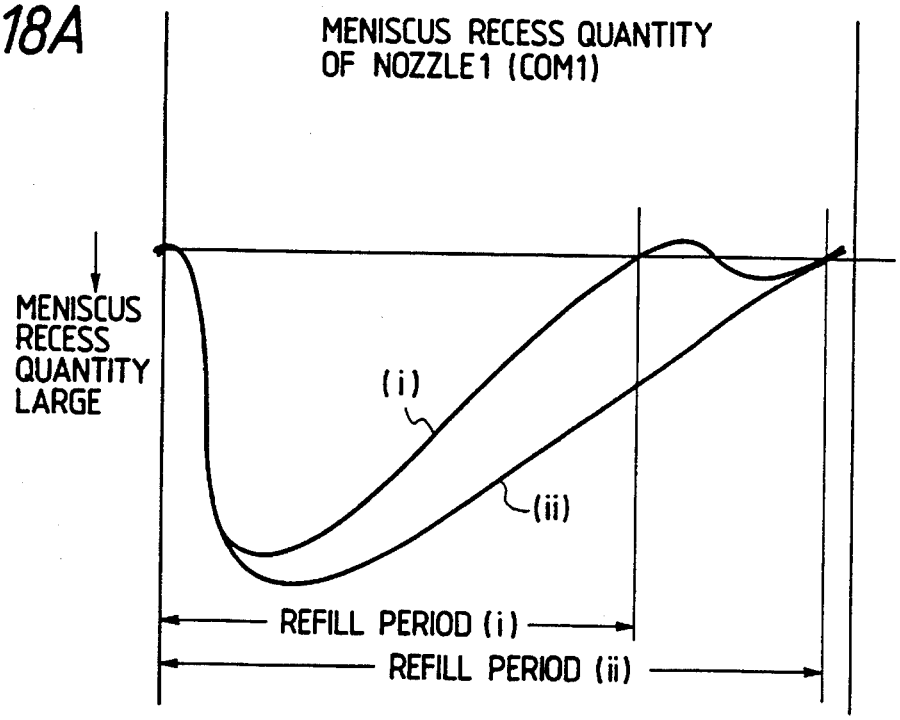
FIGS. 18A to 18C are graphs showing a difference in refill period due to a difference between a maximum meniscus recess quantity and a refill speed when an ejection reactive pressure wave is received and not received after an ink is ejected from the first nozzle.
Figure 18B:
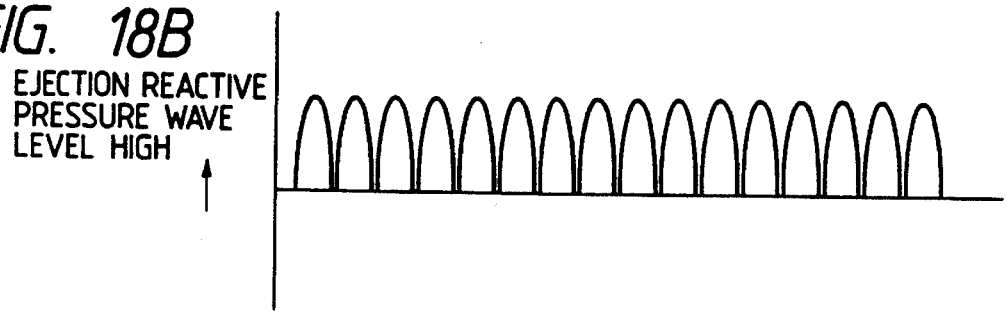
Figure 18C:
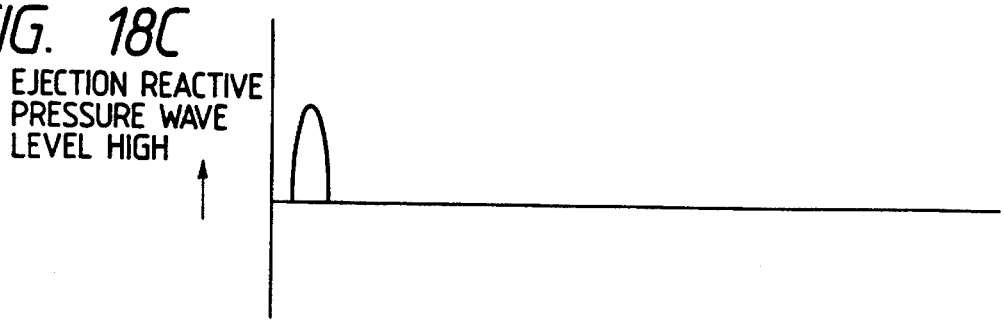

FIGS. 17A and 17B are respectively a timing chart of driving pulses of a conventional driving method, and a graph time-serially showing the meniscus recess quantity at each nozzle (ejection orifice). FIGS. 18A to 18C are graphs for explaining the influence of an ejection reactive pressure wave on the meniscus recess quantity and the refill speed.

The cause of generation of an undesirable discharge of the second dot described above will be examined below with reference to FIGS. 17A and 17B. In addition to the problem of the large transient inertial force of an ink, the conventional driving method suffers from the following causes. In the conventional driving method, driving pulses are concentrated in the former half of an ejection period. In this driving method, as can be seen from in FIG. 17B, the maximum meniscus recess quantity is increased in latter half ejection nozzles in the same driving period, and the refill speed is lowered. Therefore, the refill period is considerably prolonged by the mutual effect of two factors, i.e., an increase in refill distance and a decrease in refill speed caused by an increase in maximum meniscus quantity.

The reason why the above-mentioned phenomenon occurs in a region other than the above-mentioned transient region will be described below with reference to FIGS. 18A to 18C. FIG. 18A shows changes in meniscus recess quantity in a case (i) wherein an ejection reactive pressure wave is applied a large number of times (15 times), as shown in FIG. 18B, and in a case (ii) wherein no ejection reactive pressure wave is applied, as shown in FIG. 18C. As can be seen from FIGS. 18A to 18C, when the ejection reactive pressure wave is received, the maximum meniscus recess quantity is small, and the refill speed is high since the inclination of a refill curve is large.

The maximum meniscus recess quantity is normally determined by the negative pressure level in the common ink chamber and the impedance design value of a nozzle. However, the present inventors found that when an instantaneous positive pressure wave generated as a reaction of ejection and propagating toward the common ink chamber was applied by continuous ejection at the next and subsequent timings in the same ejection period before the maximum meniscus recess point was reached, the meniscus which was in the process of being recessed at high speed by the inertial force of an ejection reaction in a nozzle lost the inertial force by shock, and the maximum recess position became shallow. It is effective to apply an ejection reactive wave a large number of times (e.g., twice rather than once).

Similarly, the refill speed is normally determined by the negative pressure level in the common ink chamber and the impedance design value of a nozzle. However, when an instantaneous positive pressure wave as a reaction of ejection is applied a large number of times during a refill operation by continuous ejection at the next and subsequent timings in the same ejection period, the refill speed can be increased. It is important to receive an ejection reactive pressure wave a large number of times as much as possible from an early timing at the beginning of the refill operation in a refill profile of a nozzle.

From this point of view, the prior art shown in FIGS. 17A and 17B will be examined below. As can be seen from FIG. 17B, the maximum meniscus recess quantity and the refill speed gradually change in the order of a nozzle 1 (COM1), a nozzle 9 (COM2), a nozzle 17 (COM3), . . . , a nozzle 57 (COM8). Since the nozzle at the ejection timing of COM1 receives all the ejection reactive pressure waves of the following ejection operations from the early stage of the refill operation, the refill speed becomes highest. As the ejection timing advances to the latter half like COM2, COM3, . . . , COM8, the number of times of reception of ejection reactive pressure waves is decreased, and the refill speed is lowered. Furthermore, since a nozzle at the ejection timing COM8 does not receive an ejection reactive pressure wave, the maximum meniscus recess quantity is maximized, and a certain refill time is required.

In the worst case, i.e., when a problem is caused by the inertial force of an ink as the above-mentioned cause system and a steady problem caused by an ejection reaction simultaneously occur, ejection becomes further unstable.

Figure 19A:
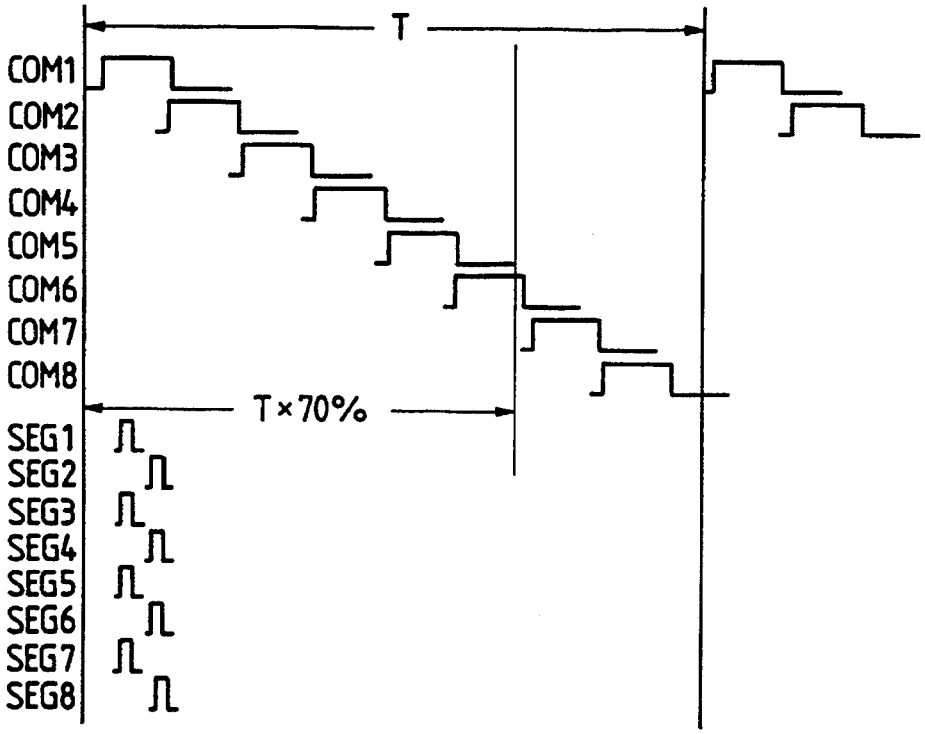
FIGS. 19A and 19B are respectively a timing chart and a graph for explaining a driving method of a recording head of this embodiment.
Figure 19B:
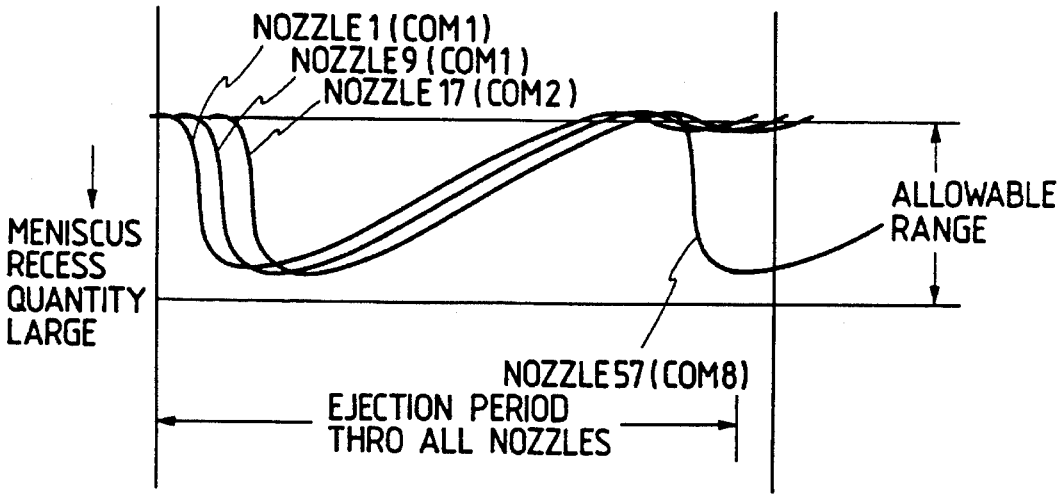
Figure 20:
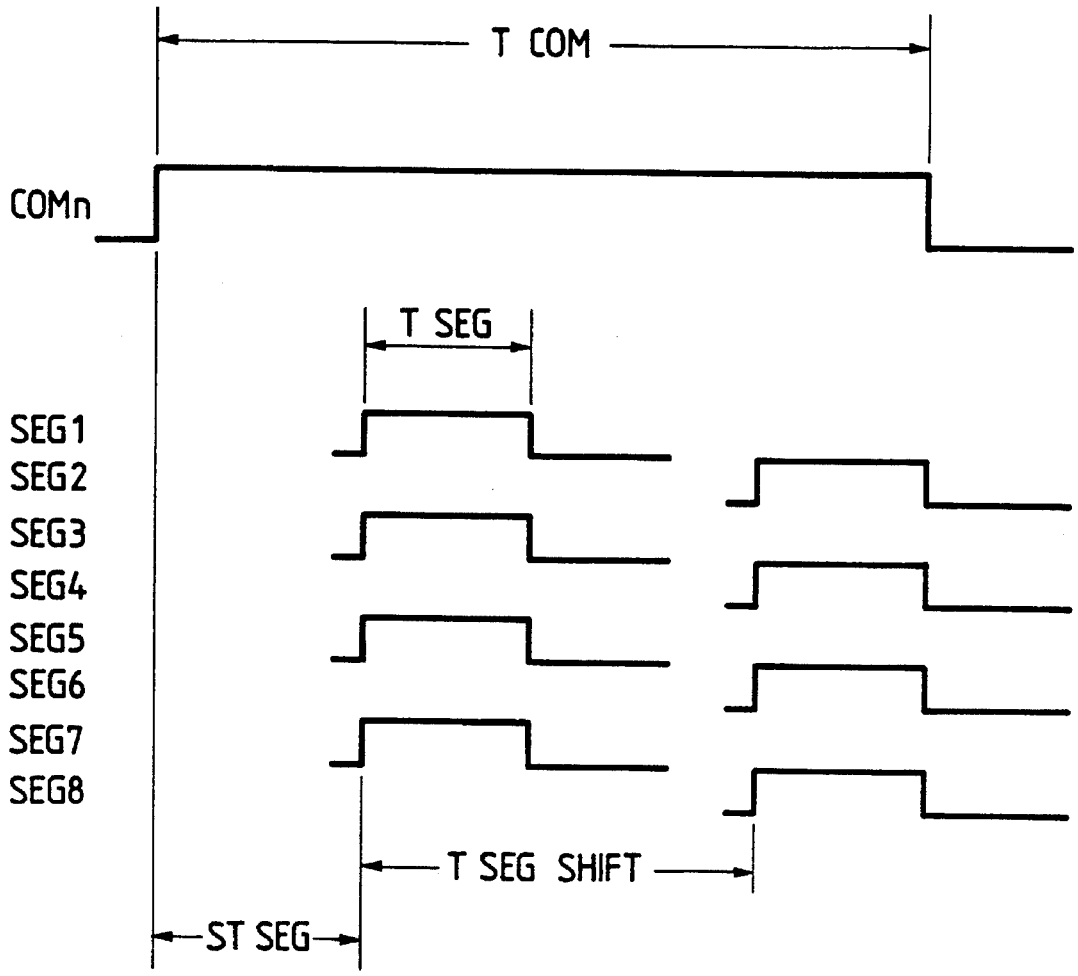
FIG. 20 is a timing chart showing details of segment signals SEG1 to SEG8 in an n-th common signal COMn in FIG. 19A.

The fifth embodiment of the present invention based on the above-mentioned examination will be described below with reference to FIGS, 19A to 20. FIG. 19A is a timing chart of driving pulses based on a recording head driving method according to this embodiment, and FIG. 19B is a graph showing a meniscus recess quantity and a refill state at that time. FIG. 20 is a timing chart showing details of segment signals SEG1 to SEG8 in an n-th common signal COMn in FIG. 19A. This embodiment is arranged to generate ejection reactive waves shown in FIG. 18B. More specifically, a signal output method is different from that in the prior art shown in FIGS. 17A and 17B, and the timings of segment signals SEG are shifted so as to inhibit adjacent nozzles from being subjected to ejection. Furthermore, since common signals COM are originally shifted like in the prior art, the ejection heaters H1 to H64 perform ejection in units of four nozzles without performing ejection at adjacent nozzles.

More specifically, as shown in FIG. 20, after an elapse of a predetermined delay time STSEG from the leading edge of a given common signal COMn, segment signals SEG1, SEG3, SEG5, and SEG7 go to high level, and after an elapse of a predetermined ejection pulse width TSEG, these signals go to low level. After an elapse of a time TSEG.SHIFT in FIG. 20, segment signals SEG2, SEG4, SEG6, and SEG8 go to high level. Thereafter, the same operation is repeated up to COM8. In this embodiment, for the sake of easy understanding of timings, the segment signals SEG1 to SEG8 are shifted not to overlap each other at all. In accordance with the idea of the present invention, it is important that maximum points of a bubble generation pressure generated by these pulse currents (signals) are not attained at the same timing. For example, when the number of nozzles is large, and when a time until generation of a bubble is long, some segment signals may overlap each other in a single common signal. The time TSEG.SHIFT is defined with reference to the leading edge of a segment signal, but may be defined with reference to the trailing edge of the segment signal.

In this manner, the effect of an increase in degree of freedom of flow-in directions of the ink is utilized in maximum by effectively using ejection reactive pressure waves, and an ink refill operation to nozzles can be performed at high speed.

The increase in degree of freedom of flow-in directions of the ink has the following meaning. A case will be examined below wherein adjacent nozzles are driven at the same time. When a nozzle after ejection starts a refill operation, ink flow-in directions to all the nozzles are aligned in the same direction to be parallel to each other. For this reason, the ink can only be supplied from a direction immediately behind a nozzle, and a nozzle is equivalently prolonged. However, when adjacent nozzles are inhibited from being driven at the same time, the ink can flow in from a direction of an adjacent nozzle, which is not subjected to ejection, and the degree of freedom of ink flow-in direction can be increased. Furthermore, when the ejection phase is shifted, the vector of an ink flow behind a nozzle subjected to ejection is directed in a direction opposite to a refill direction. However, an adjacent nozzle can obtain an ink flow toward the nozzle by ejection reactive pressure waves of the following adjacent nozzles.

In this embodiment, ejection is performed as described above. It is more important that when all the ejection enabled nozzles are subjected to ejection within an ejection period T, ejection is performed so that a time required for completing ejection from the first nozzle to the last nozzle (64th nozzle) becomes about 70% or more (90% in this embodiment) of the ejection period T. When ejection according to this embodiment is performed, the negative pressure in the common ink chamber as one cause system can fall within an allowable range so as not to adversely influence ejection (see the first embodiment). Furthermore, as for other cause systems, ejection reactive pressure waves by ejection in the next driving period can be applied in an early refill period in nozzles subjected to ejection in the latter half of the ejection period, and a refill period can be greatly shortened. More specifically, in FIGS. 19A and 19B, ejection operations at timings of COM1, COM2, . . . can receive ejection reactive pressure waves generated by the following ejection operations, and furthermore, ejection operations at timings of COM7 and COM8 can receive ejection reactive pressure waves generated by ejection operations at timings COM1, COM2, . . . in the next driving period. Therefore, the refill period can be greatly shortened in all the nozzles.

More specifically, when pulses for normal ejection are flowed through the heaters of the recording head, a bubble begins to grow after an elapse of about 2 μsec, and reaches a maximum bubble volume in about 10 to 20 μsec. Near this timing, a pressure wave in the common ink chamber based on ejection reactive pressure waves is maximized. The meniscus recess quantity is also maximized near this-timing (i.e., about 20 μsec). Therefore, if a time difference between a nozzle to be subjected to ejection and a nozzle subjected to immediately preceding ejection is less than 20 μsec, ejection reactive pressure waves can be applied to the recessing meniscus, thus suppressing the maximum meniscus recess quantity.

Even when a peak is formed after the maximum meniscus recess quantity is reached, an improvement effect of the refill speed to be described below can be still expected. In this case, it is important to fully use the minimum driving period of the recording head up to the end. That is, it is important that as soon as the last ejection in a given minimum driving period is ended, the first ejection of the next minimum driving period is started to apply ejection reactive pressure waves to the latter half nozzles in a refill operation in the previous minimum driving period. The total refill period can be most effectively shortened by applying ejection reactive pressure waves at a possibly early timing of a refill operation of a nozzle so as to quickly change the vector of an ink flow directed toward the common ink chamber in a direction to a nozzle.

Of course, when ejection reactive pressure waves are applied before the maximum meniscus recess quantity is reached, and the nozzles are driven by fully using the minimum driving period, the refill time can be most shortened in all the nozzles.

That is, in place of generation of driving pulses concentrated in the former half of the minimum driving period, the minimum driving period is fully used, and the next ejection reactive pressure wave is applied near the maximum meniscus recess quantity, and preferably, immediately before the maximum meniscus recess quantity is reached. More specifically, it is most ideal to determine the number of nozzles to be simultaneously subjected to ejection on the basis the number of nozzles obtained by dividing the number of all the ejection enabled nozzles with a value obtained by dividing the minimum driving period with a time of a nozzle, which reaches the maximum meniscus recess quantity earliest. In practice, since there is a problem of, e.g., the number of head drivers, the most ideal number of nozzles is preferably selected within a range satisfying the above-mentioned conditions.

[Sixth Embodiment]

Figure 21:
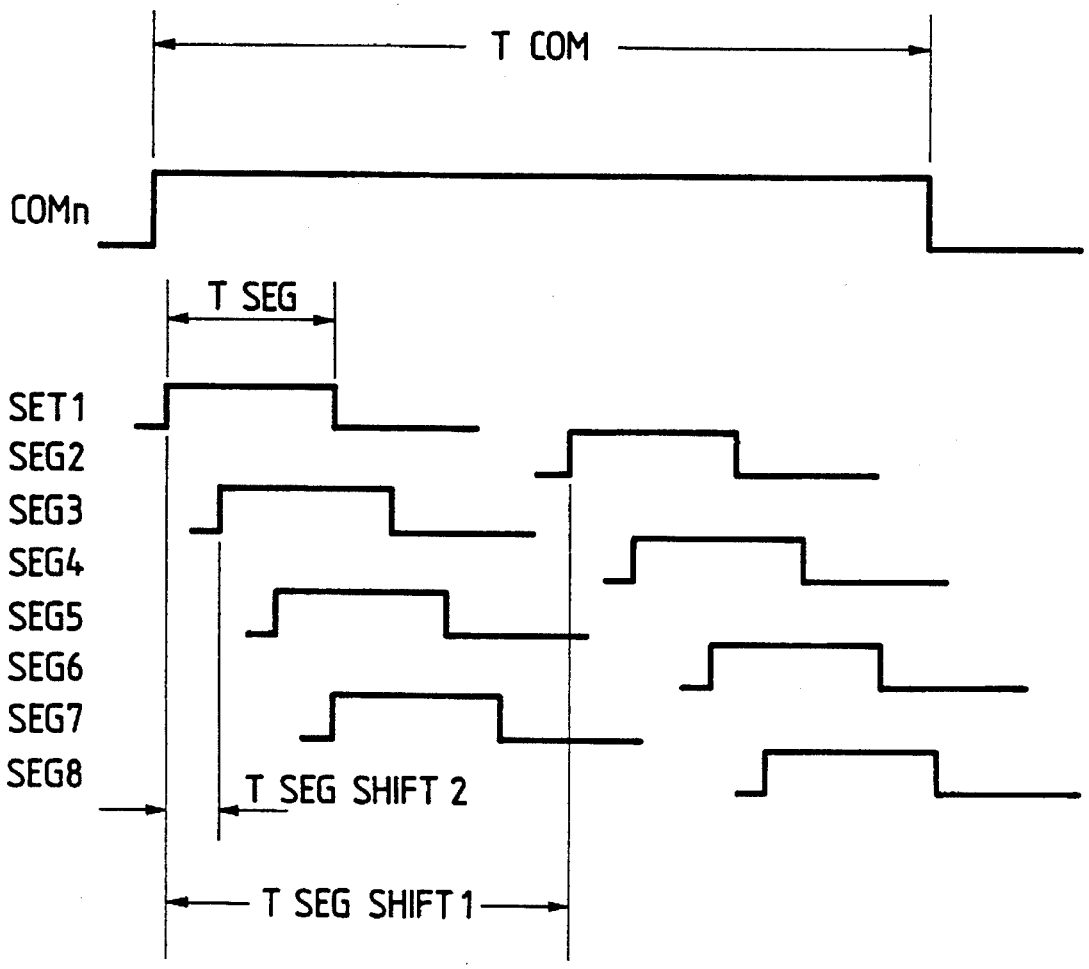
FIG. 21 is a timing chart for explaining the fourth embodiment of the present invention.

In the fifth embodiment, segment signals SEG are classified in correspondence with odd-numbered nozzles and even-numbered nozzles in a common signal COM to set the first and second timings, and the interval between the first and second timings is set to be a time immediately before the maximum meniscus recess quantity is reached. Furthermore, the same applies to the interval between the second timing and the next common signal COM. In this embodiment, as shown in FIG. 21, after segment signals SEG are classified in correspondence with odd- and even-numbered nozzles, the timings of the segment signals are shifted so as to prevent all the nozzles from attaining a maximum bubble generation pressure at the same timing. In this manner, since the most effective ejection reactive pressure wave can be generated at every timing and at a position adjacent to a nozzle which is about to reach a maximum meniscus recess quantity, a remarkable effect can also be obtained.

The arrangement and driving conditions of the recording head of this embodiment are the same as those in the first embodiment.

[Seventh Embodiment]

Figure 22:
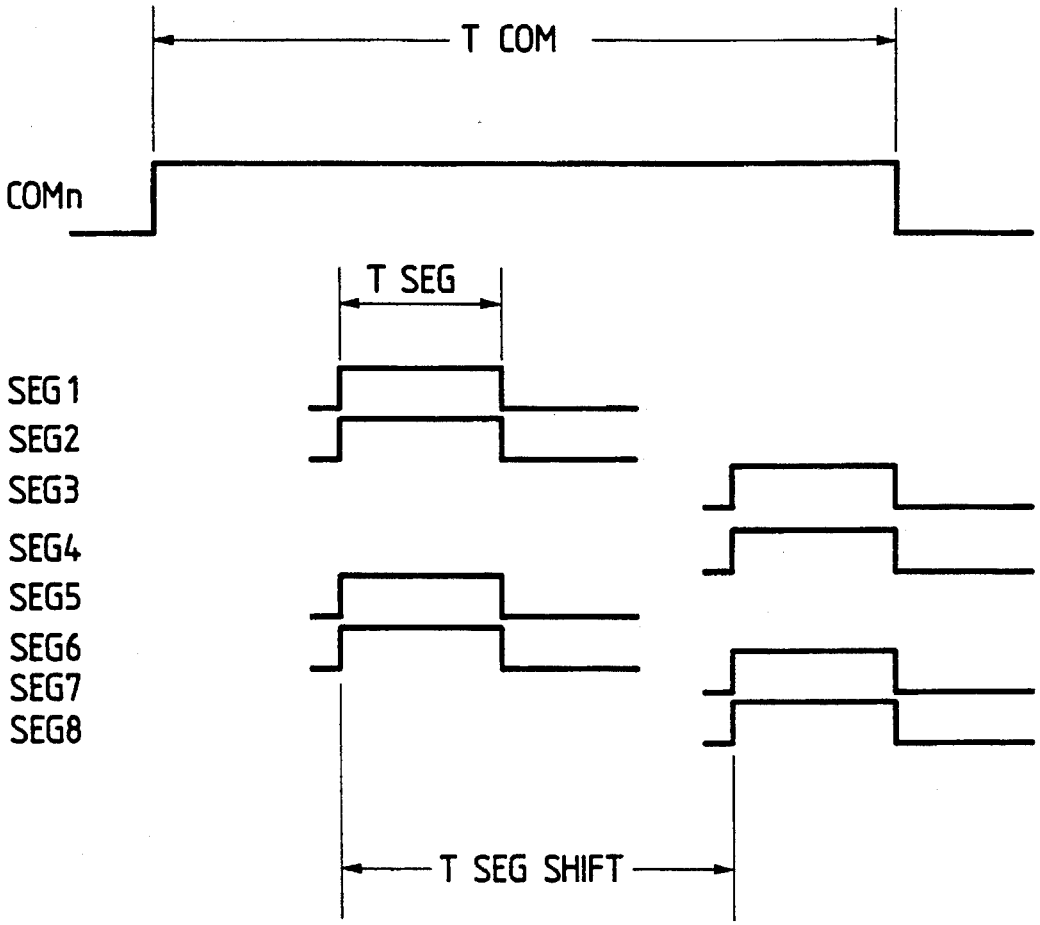
FIG. 22 is a timing chart for explaining the fifth embodiment of the present invention.

In the seventh embodiment shown in FIG. 22, two out of 64 nozzles are simultaneously driven. In this embodiment, the negative pressure in the common ink chamber can be prevented from being increased like in the fifth and sixth embodiments, and the timings of nozzles subjected to continuous ejection are set immediately before a maximum meniscus recess quantity is reached. Therefore, ink ejection can be satisfactorily performed.

Figure 23:
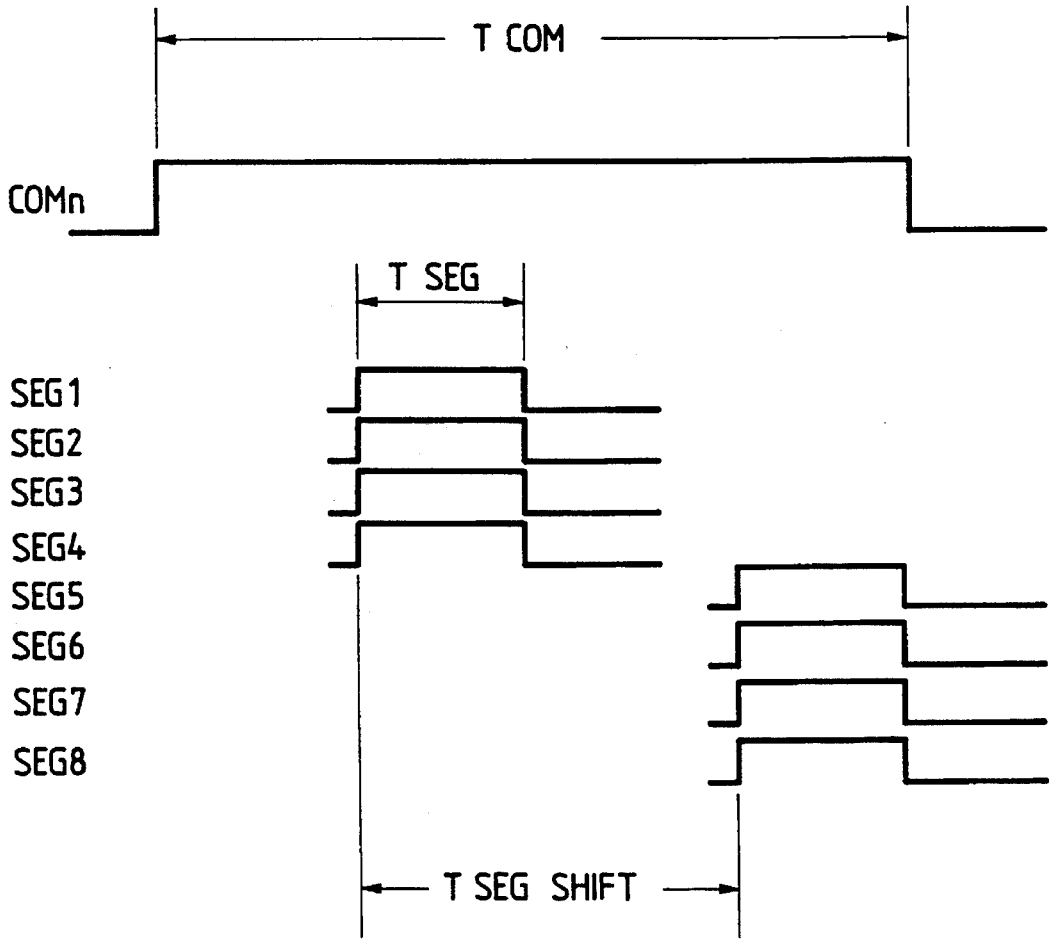
FIG. 23 is a timing chart for explaining the fifth embodiment of the present invention.
Figure 24:
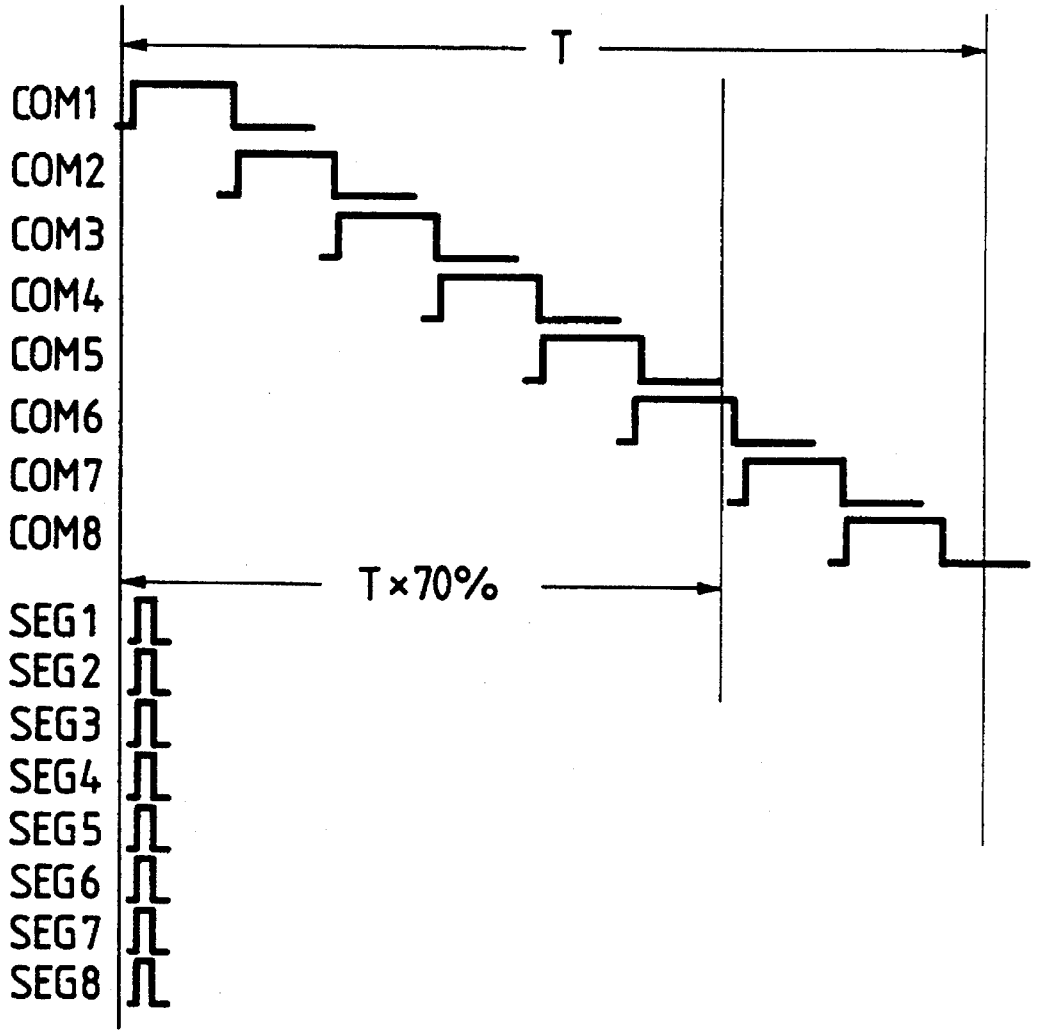
FIG. 24 is a timing chart for explaining the fifth embodiment of the present invention.

In this embodiment, according to the gist of the present invention, adjacent nozzles need not always be driven at different timings. That is, it is important to obtain the next ejection reactive pressure wave before a maximum meniscus recess quantity is reached using 70% or more of the minimum driving period, and the number of ejection nozzles is preferably determined to satisfy this condition. However, as described above, when adjacent nozzles are inhibited from being subjected to ejection at the same time, the effect of increasing the degree of freedom of ink flow-in directions from the common ink chamber to nozzles, and the effect of applying ejection reactive pressure waves to a nozzle adjacent to a nozzle to which an ejection reactive pressure wave is applied can be maximized. According to this gist, continuous four nozzles can be subjected to simultaneous ejection, as shown in FIG. 23. Furthermore, even in a driving design shown in FIG. 24, the effect of the present invention can be obtained as long as a condition that the next ejection reaction pressure wave is obtained near a maximum meniscus recess quantity, and preferably, immediately before the maximum meniscus recess quantity is reached using 70% or more of the minimum driving period is satisfied. In this case, the strength of an ejection reactive pressure wave is decreased as a nozzle position is separated away from a nozzle which generates the ejection reactive pressure wave even when the phase remains the same. Therefore, a certain margin must be provided accordingly.

[Eighth Embodiment]

When the number of ejection nozzles in the latter half of a minimum driving period wherein the refill speed is lowered is decreased, the number of nozzles, which cannot effectively use ejection reactive pressure waves, can be decreased. More specifically, a timing at which an ejection reactive pressure wave can be most effectively used, and both the maximum meniscus recess quantity and refill speed are satisfactory is the first timing of ejection nozzles in the minimum driving period. Therefore, the number of ejection nozzles corresponding to the most advantageous first timing in the minimum driving period is set to be largest, and the number of nozzles is sequentially decreased toward the latter half of the minimum driving period.

Figure 25:
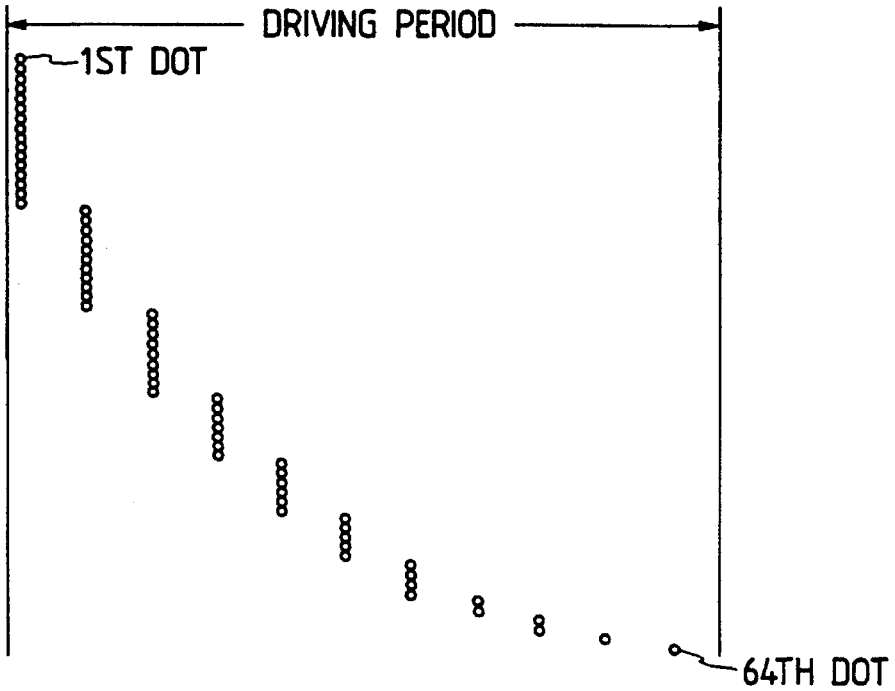
FIG. 25 is a timing chart for explaining the sixth embodiment of the present invention.
Figure 26:
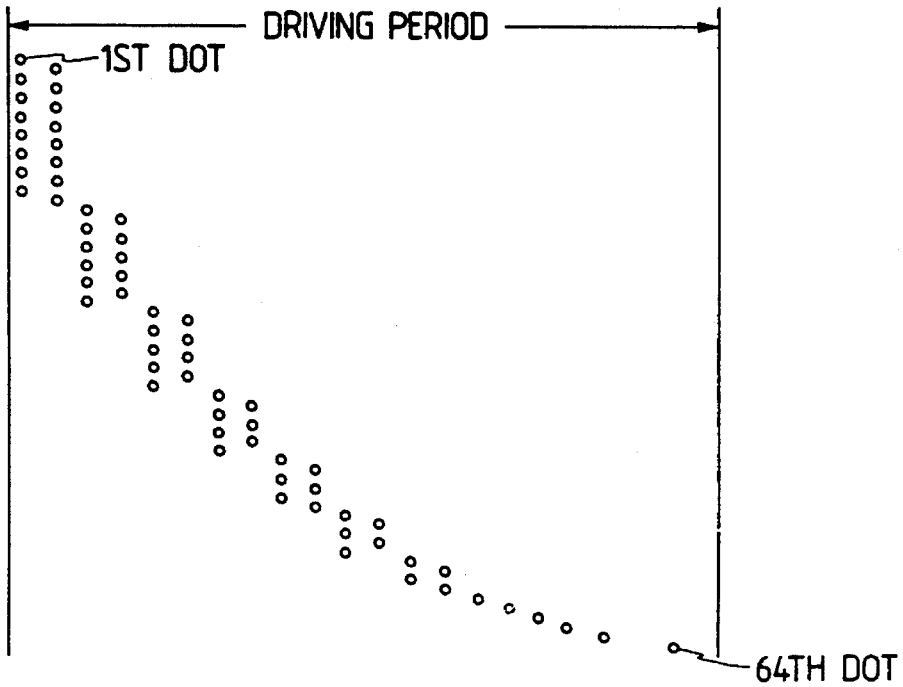
FIG. 26 is a timing chart for explaining the sixth embodiment of the present invention.

More specifically, when the numbers of ejection nozzles are set, as shown in FIGS. 25 and 26, the number of ejection nozzles at the most disadvantageous ejection timing in the latter half of ejection is decreased to prevent a high negative pressure from being generated so as to suppress a decrease in maximum meniscus recess quantity and a decrease in refill speed. In this embodiment, the numbers of nozzles are sequentially decreased. However, the numbers of nozzles in only the latter half may be sequentially decreased. More specifically, in the former half ejection in the minimum driving period in which ejection reactive pressure waves can be most effectively utilized, the number of ejection nozzles is increased as much as possible to complete a refill operation early. When nozzles in the latter half of the minimum driving period start ejection, since the number of nozzles to be subjected to a refill operation is decreased, an excessive negative pressure can be prevented from being applied to only the latter half nozzles, thereby making uniform the refill period.

As described above, according to the present invention, in an ink jet recording apparatus for performing recording by ejecting an ink, the amplitude of a refill oscillation is minimized to stabilize ejection. In addition, the maximum meniscus recess quantity upon ejection of an ink is minimized to increase the ink refill speed, thereby stabilizing ejection. Thus, both the high-speed printing operation and high image quality can be realized.

The present invention brings about excellent effects particularly in a recording head and a recording device of the ink jet system using a thermal energy among the ink jet recording systems.

As to its representative construction and principle, for example, one practiced by use of the basic principle disclosed in, for instance, U.S. Pat. Nos. 4,723,129 and 4,740,796 is preferred. The above system is applicable to either one of the so-called on-demand type and the continuous type. Particularly, the case of the on-demand type is effective because, by applying at least one driving signal which gives rapid temperature elevation exceeding nucleate boiling corresponding to the recording information on electrothermal converting elements arranged in a range corresponding to the sheet or liquid channels holding liquid (ink), a heat energy is generated by the electrothermal converting elements to effect film boiling on the heat acting surface of the recording head, and consequently the bubbles within the liquid (ink) can be formed in correspondence to the driving signals one by one. By discharging the liquid (ink) through a discharge port by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in accordance with characteristics. As the driving signals of such pulse shapes, the signals as disclosed in U.S. Pat. Nos. 4,463,359 and 4,345,262 are suitable. Further excellent recording can be performed by using the conditions described in U.S. Pat. No. 4,313,124 of the invention concerning the temperature elevation rate of the above-mentioned heat acting surface.

As a construction of the recording head, in addition to the combined construction of a discharging orifice, a liquid channel, and an electrothermal converting element (linear liquid channel or right angle liquid channel) as disclosed in the above specifications, the construction by use of U.S. Pat. Nos. 4,558,333 and 4,459,600 disclosing the construction having the heat acting portion arranged in the flexed region is also included in the invention. The present invention can be also effectively constructed as disclosed in Japanese Laid-Open Patent Application No. 59-123670 which discloses the construction using a slit common to a plurality of electrothermal converting elements as a discharging portion of the electrothermal converting element or Japanese Laid-Open Patent Application No. 59-138461 which discloses the construction having the opening for absorbing a pressure wave of a heat energy corresponding to the discharging portion.

Further, as a recording head of the full line type having a length corresponding to the maximum width of a recording medium which can be recorded by the recording device, either the construction which satisfies its length by a combination of a plurality of recording heads as disclosed in the above specifications or the construction as a single recording head which has integratedly been formed can be used. The present invention can exhibit the effects as described above more effectively.

In addition, the invention is effective for a recording head of the freely exchangeable chip type which enables electrical connection to the main device or supply of ink from the main device by being mounted onto the main device, or for the case by use of a recording head of the cartridge type provided integratedly on the recording head itself.

It is also preferable to add a restoration means for the recording head, preliminary auxiliary means, and the like provided as a construction of the recording device of the invention because the effect of the invention can be further stabilized. Specific examples of them may include, for the recording head, capping means, cleaning means, pressurization or aspiration means, and electrothermal converting elements or another heating element or preliminary heating means according to a combination of them. It is also effective for performing a stable recording to realize the preliminary mode which executes the discharging separately from the recording.

As a recording mode of the recording device, further, the invention is extremely effective for not only the recording mode of only a primary color such as black or the like but also a device having at least one of a plurality of different colors or a full color by color mixing, depending on whether the recording head may be either integratedly constructed or combined in plural number.

What is claimed is:

1. An ink jet recording apparatus comprising:

a recording head having a plurality of ejection orifices for ejecting an ink, and a common ink chamber for supplying the ink to said plurality of ejection orifices; and driving means for causing said plurality of ejection orifices of said recording head to eject the ink, wherein said driving means causes a number of the ejection orifices to eject an ink quantity at a same timing, the ink quantity being not more than 7% of an ink quantity to be ejected from all of said plurality of ejection orifices of said recording head, and sets an ink ejection period required for ejecting the ink from all of said plurality of ejection orifices to be not less than 70% of a driving period.

2. An apparatus according to claim 1, wherein said driving means causes adjacent ejection orifices to eject the ink at continuous timings.

3. An apparatus according to claim 1, wherein said driving means inhibits adjacent ejection orifices from ejecting the ink at continuous timings.

4. An apparatus according to claim 1, wherein said driving means causes only one ejection orifice to eject the ink at a single timing.

5. An apparatus according to claim 1, wherein said driving means causes each ejection orifice to eject the ink at a maximum ejection pressure generation timing of the ejection orifice.

6. An apparatus according to claim 1, wherein said recording head causes a change in state including formation of a bubble in the ink by a heat energy, and ejects the ink based on the change in state.

7. An ink jet recording apparatus comprising:

a recording head having at least 32 ejection orifices for ejecting an ink, and a common ink chamber for supplying the ink to said ejection orifices; and driving means for causing said ejection orifices of said recording head to eject the ink, wherein said driving means causes a number of the ejection orifices to eject an ink quantity at a same timing, the ink quantity being not more than 12.5% of an ink quantity to be ejected from all of said plurality of ejection orifices of said recording head, and sets an ink ejection period required for ejecting the ink from all of said plurality of ejection orifices to be not less than 90% of a driving period.

8. An apparatus according to claim 7, wherein said driving means causes adjacent ejection orifices to eject the ink at continuous timings.

9. An apparatus according to claim 7, wherein said driving means inhibits adjacent ejection orifices from ejecting the ink at continuous timings.

10. An apparatus according to claim 7, wherein said driving means causes only one ejection orifice to eject the ink at a single timing.

11. An apparatus according to claim 7, wherein said driving means causes each ejection orifice to eject the ink at a maximum ejection pressure generation timing of the ejection orifice.

12. An apparatus according to claim 7, wherein said recording head causes a change in state including formation of a bubble in the ink by heat energy, and ejects the ink based on the change in state.

* * * * *

UNITED STATES PATENT AND TRADEMARK OFFICE

CERTIFICATE OF CORRECTION

PATENT NO. : 5,481,281

DATED : January 2, 1996

INVENTOR(S) : Naoji OTSUKA, et al.

It is certified that error appears in the above-indentified patent and that said Letters Patent is hereby corrected as shown below:

On the title page, item

[56] References Cited - FOREIGN PATENT DOCUMENTS:

"1180353 7/1989 Japan" should read --1-180353 7/1989 Japan--.

COLUMN 20:

Line 13, "this-timing" should read --this timing--.

COLUMN 24:

Line 15, "by a" should read --by--.

Signed and Sealed this

Twenty-eighth Day of May, 1996

Bruce Lehman

*Attest:*

BRUCE LEHMAN

*Attesting Officer*

*Commissioner of Patents and Trademarks*